US011148869B2

(12) United States Patent
Dunlap

(10) Patent No.: US 11,148,869 B2
(45) Date of Patent: Oct. 19, 2021

(54) WATER RESISTANT TOTE BOX

(71) Applicant: Richard Dunlap, Phoenix, AZ (US)

(72) Inventor: Richard Dunlap, Phoenix, AZ (US)

( * ) Notice: Subject to any disclaimer, the term of this patent is extended or adjusted under 35 U.S.C. 154(b) by 203 days.

(21) Appl. No.: 16/091,760

(22) PCT Filed: Apr. 7, 2017

(86) PCT No.: PCT/US2017/026567
§ 371 (c)(1),
(2) Date: Oct. 5, 2018

(87) PCT Pub. No.: WO2017/177166
PCT Pub. Date: Oct. 12, 2017

(65) Prior Publication Data

US 2019/0127137 A1 May 2, 2019

Related U.S. Application Data

(60) Provisional application No. 62/319,649, filed on Apr. 7, 2016.

(51) Int. Cl.
*B65D 45/16* (2006.01)
*B65D 81/26* (2006.01)
(Continued)

(52) U.S. Cl.
CPC ..... *B65D 81/261* (2013.01); *B65D 1/22* (2013.01); *B65D 1/246* (2013.01); *B65D 1/46* (2013.01);
(Continued)

(58) Field of Classification Search
CPC ..... B65D 81/18; B65D 81/261; B65D 1/22; B65D 1/246; B65D 1/46; B65D 21/0223; B65D 43/164; B65D 2251/1083
(Continued)

(56) References Cited

U.S. PATENT DOCUMENTS 3,463,345 A 8/1969 Bockenstette
5,328,048 A * 7/1994 Stein ..... B65D 43/16 220/315
(Continued)

*Primary Examiner* — James N Smalley
*Assistant Examiner* — Elizabeth J Volz
(74) *Attorney, Agent, or Firm* — Boudwin Intellectual Property; Daniel Boudwin

(57) ABSTRACT

A water resistant tote box is provided. The tote box includes a base, longitudinally extending sidewalls, laterally extending end walls, and a two-piece lid. The base includes a concave lower surface that matches a convex upper surface of the lid, for preserving the structural integrity of the convex upper surface when stacking a like tote box thereon. The two-piece lid includes a pair of lid halves including a rear end hingedly attached to the sidewalls and a free end including interlocking flaps that are securable via a line of connection. Drain troughs disposed on the walls are in fluid communication with drain channels disposed on the lid, enabling moisture to flow off the top of the tote box. Drain gutters disposed on the lid halves are configured to direct moisture, permeating the line of connection, towards the walls. In this way, the tote box has a synergistic effect of resisting water by directing moisture away from the top of the tote box and preventing moisture from leaking into its interior.

30 Claims, 19 Drawing Sheets

(51) Int. Cl.

| | |
|---|---|
| ***B65D 43/16*** | (2006.01) |
| ***B65D 81/18*** | (2006.01) |
| ***B65D 1/24*** | (2006.01) |
| ***B65D 1/22*** | (2006.01) |
| ***B65D 1/46*** | (2006.01) |
| ***B65D 21/02*** | (2006.01) |

(52) U.S. Cl.
CPC ..... *B65D 21/0223* (2013.01); *B65D 43/164* (2013.01); *B65D 81/18* (2013.01)

(58) Field of Classification Search
USPC ..... 220/810, 819, 826
See application file for complete search history.

(56) References Cited

U.S. PATENT DOCUMENTS

| | | | | |
|---|---|---|---|---|
| 5,353,948 | A * | 10/1994 | Lanoue ..... | B65D 21/064 220/826 |
| 5,794,770 | A | 8/1998 | Plomgren et al. | |
| 6,000,576 | A | 12/1999 | Liu | |
| 6,431,394 | B2 | 8/2002 | Frankenberg | |
| 8,066,143 | B2 * | 11/2011 | Baltz ..... | B65D 21/064 220/324 |

* cited by examiner

WATER RESISTANT TOTE BOX

CROSS REFERENCE TO RELATED APPLICATIONS

This application claims the benefit of U.S. Provisional Application No. 62/319,649 filed on Apr. 7, 2016. The above identified patent application is herein incorporated by reference in its entirety to provide continuity of disclosure.

BACKGROUND OF THE INVENTION

The present invention relates to storage containers. More specifically, the present invention relates to a tote box including a water resistant lid having a convex upper surface and drains configured to conjunctively, channel moisture disposed on and permeating the upper surface of the tote box towards the sides of the container.

Tote boxes have been known for a number of years and have found widespread usage in commercial and residential applications. Such boxes have been available having no lids, with one-piece lids which enclose the entire top of the tote box, or with two-piece lids, each lid half of which is hinged along one side of the tote box and in which the halves meet along a line of closure generally in the middle of a top of the tote box. These tote boxes are used for storing and transporting parts or other items and are reusable. The tote boxes and their lids are also typically made of plastic materials which are recyclable.

Tote boxes having two-piece lids are particularly troublesome when a heavy object is placed on the lid, such as another tote box. The heavy object may cause the tote box sides to flex outward or the lid to flex downward, separating the two-piece lid and allowing the object to fall into the tote box, moisture to permeate the two-piece lids' line of connection, or simply compromising the structural integrity of the box. Therefore, it is desirable that the tote box be reinforced to prevent the flexing/bowing/bending of a tote box when a heavy object is placed thereon or when another tote box is stacked thereon.

Moreover, during shipment and storage, known tote boxes, individually and in stacks, are typically subjected to moisture, such as rain, condensation, accidental or intentional spraying of liquid, or leakage from an upper tote box to a lower tote box. If this moisture is permitted to enter the tote box, it can damage the items contained in the tote box. Therefore, it is desirable that the tote box include a means for generally directing moisture away from the upper surface of the tote box and a means for capturing moisture permeating the tote box lid and directing the moisture away from the interior, towards the sides the tote box.

SUMMARY OF THE INVENTION

In view of the foregoing disadvantages inherent in the known types of storage containers now present in the prior art, the present invention provides a water resistant tote box wherein the same can be utilized for providing convenience for the user when storing and/or transporting parts or other items.

An example water resistant tote box according to the present invention includes a base having a pair of longitudinally extending sidewalls and a pair of laterally extending end walls extending upwardly therefrom. A lid including a pair of lid halves are hingedly connected to the sidewalls and securable at a line of connection. The lid includes a convex upper surface that facilitates the directing of moisture away from the upper surface of the tote box towards the walls. The base includes a concave lower surface that matches a convex upper surface of the lid when stacked.

A drain gutter extends along an inner perimeter edge of free ends of the lid halves towards an outer perimeter edge of the lid halves. The drain gutter slopes downwardly towards the outer perimeter edge. Interlocking flaps disposed on the free ends overlap the drain gutters on opposing lid halves at the line of connection. The drain gutter extends underneath the line of connection when the lid halves are secured and catches any moisture permeating the line of connection. A drain receptacle on the end walls of the tote box are sized to receive the drain gutters. The drain receptacles facilitate the removal of moisture caught by the drain gutters. Drain troughs disposed on the walls are in fluid communication with drain channels disposed on the lid halves. In this way, moisture directed towards the walls by the convex upper surface may flow off of the top of the tote box.

An inner shelf disposed around a perimeter edge of the lid protrudes upwardly from the lid. The inner shelf receives a tote box thereon and forms a space between the concave base of the tote box stacked thereon and the convex lid of lower tote box on which the inner shelf is disposed. The space prevents the base of the upper tote box from exerting a downward force onto the convex lid of the lower tote box and flattening the convexity thereof.

Reinforcement shoulders disposed on the walls of the tote box extend inwardly therefrom. Reinforcement ribs disposed on a lower periphery edge of a lower surface of the lid halves extend outwardly therefrom. The reinforcement ribs are aligned with the reinforcement shoulders of the sidewalls and end walls, such that the reinforcement ribs engage the reinforcement shoulder when the lid halves are secured.

These and other features of the present invention can be best understood from the following specification and drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
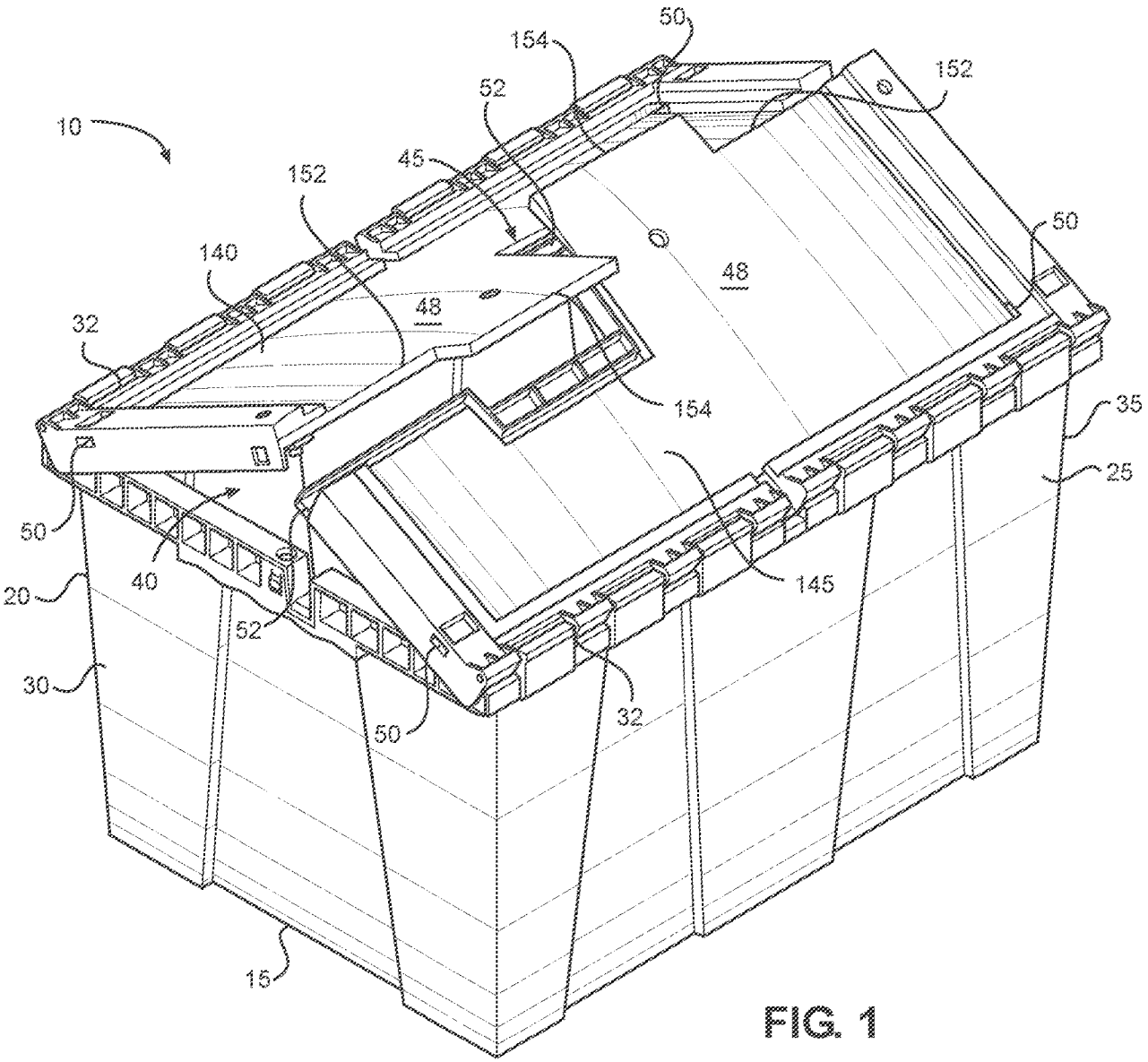
FIG. 1 shows a perspective view of water resistant tote box in a partially open configuration.

Reference is made herein to the attached drawings. Like reference numerals are used throughout the drawings to depict like or similar elements of the water resistant tote box. The figures are intended for representative purposes only and should not be considered to be limiting in any respect.

Figure 10:
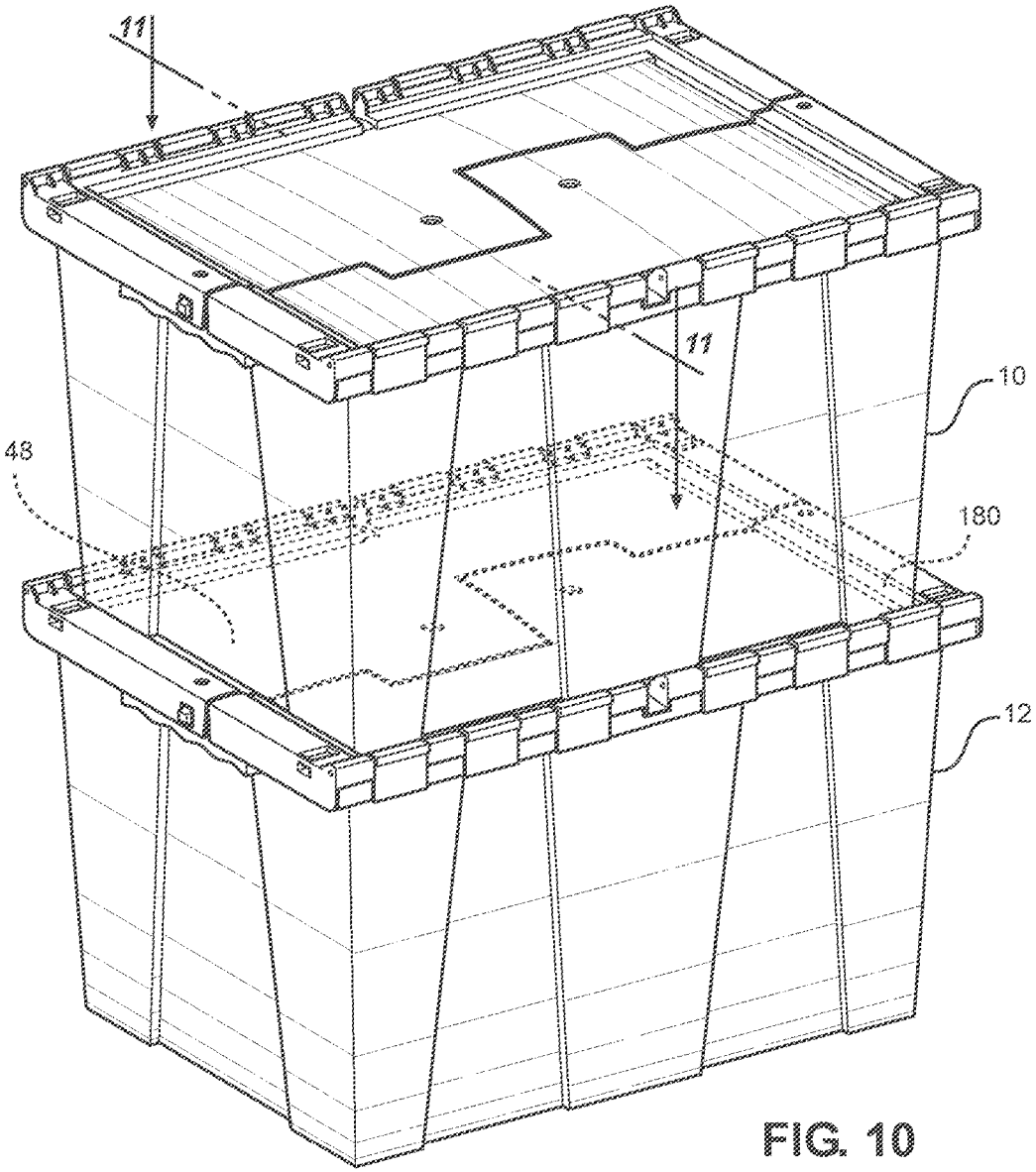
FIG. 10 shows a perspective view of the water resistant tote box in a stacked configuration.
Figure 11:
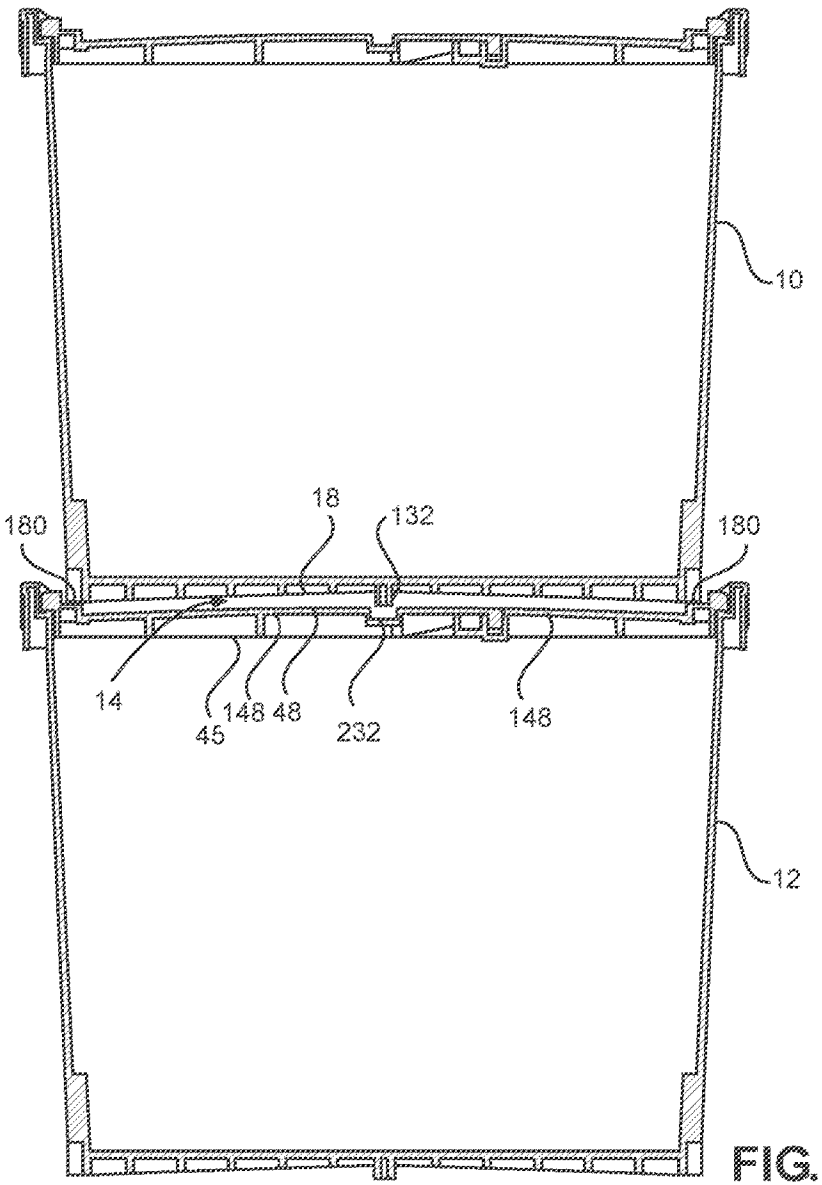
FIG. 11 shows a cross-sectional view of the water resistant tote box along line 11-11 of FIG. 10.

Referring now to FIGS. 1-4, there are shown perspective views of the water resistant tote box. The present invention provides a water resistant tote box 10 configured to direct moisture away from the upper surface of the tote box 10. The tote box 10 includes a base 15, longitudinally extending sidewalls 20, 25, laterally extending end walls 30, 35, an open upper end 40, and a two-piece lid 45. The base 15 includes a concave lower surface 18 and the lid 45 includes a matching convex upper surface 48, such that when stacking the tote box 10 on top of another like tote box 10, the curvature of the convex upper surface 48 of a first tote box 10 the curvature of the concave lower surface 18 of a second tote box 10, as shown by FIGS. 10 and 11. The two-piece lid 45 includes a pair of lid halves 140, 145 that are hingedly attached to the sidewalls 20, 25, respectively. The lid halves 140, 145 include inner perimeter edges 152 having one or more interlocking flaps 154 protruding outwardly therefrom that are securable via a line of connection 28.

The sidewalls 20, 25 and end walls 30, 35 include drain troughs 90, 68, respectively, that are in fluid communication with drain channels 50 disposed on the lid 45, when the lid 45 is secured to the open upper end 40. The drain troughs 68, 90 and drain channels 50 enable moisture to flow off the top of the tote box 10. The lid 45 further includes drain gutters 52 configured to direct moisture, permeating the line of connection 28, towards the sidewalls 20, 25 and end walls 30, 35. In this way, the convex upper surface 48, drain troughs 68, 90, drain channels 50, and drain gutters 52, synergistically, make the tote box 10 water resistant insofar as they direct moisture away from the top of the tote box 10 and prevent moisture from leaking into the interior of the tote box.

In one embodiment, the tote box 10 including the two-piece lid 45 are injection molded from a plastic material, such as polyethylene (PE), Acrylonitrile butadiene styrene (ABS), Polypropylene (PP), Polyoxmethylene (POM), Polycarbonate (PC), and Polyvinyl chloride (PVC). However, in alternative embodiments, other materials and processes could also be used.

Figure 3:
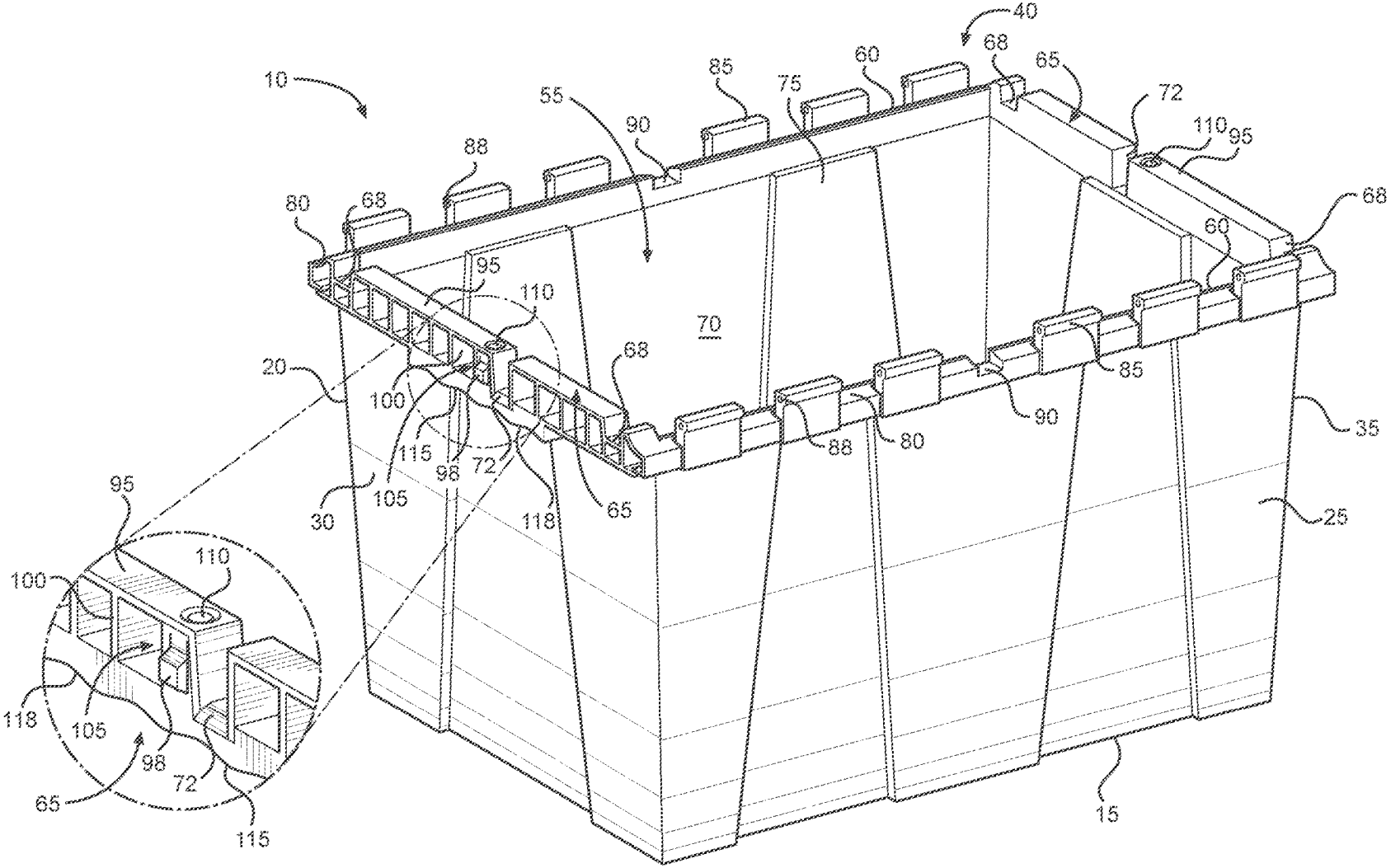
FIG. 3 shows a top perspective view of the water resistant tote box without the lid.
Figure 5:
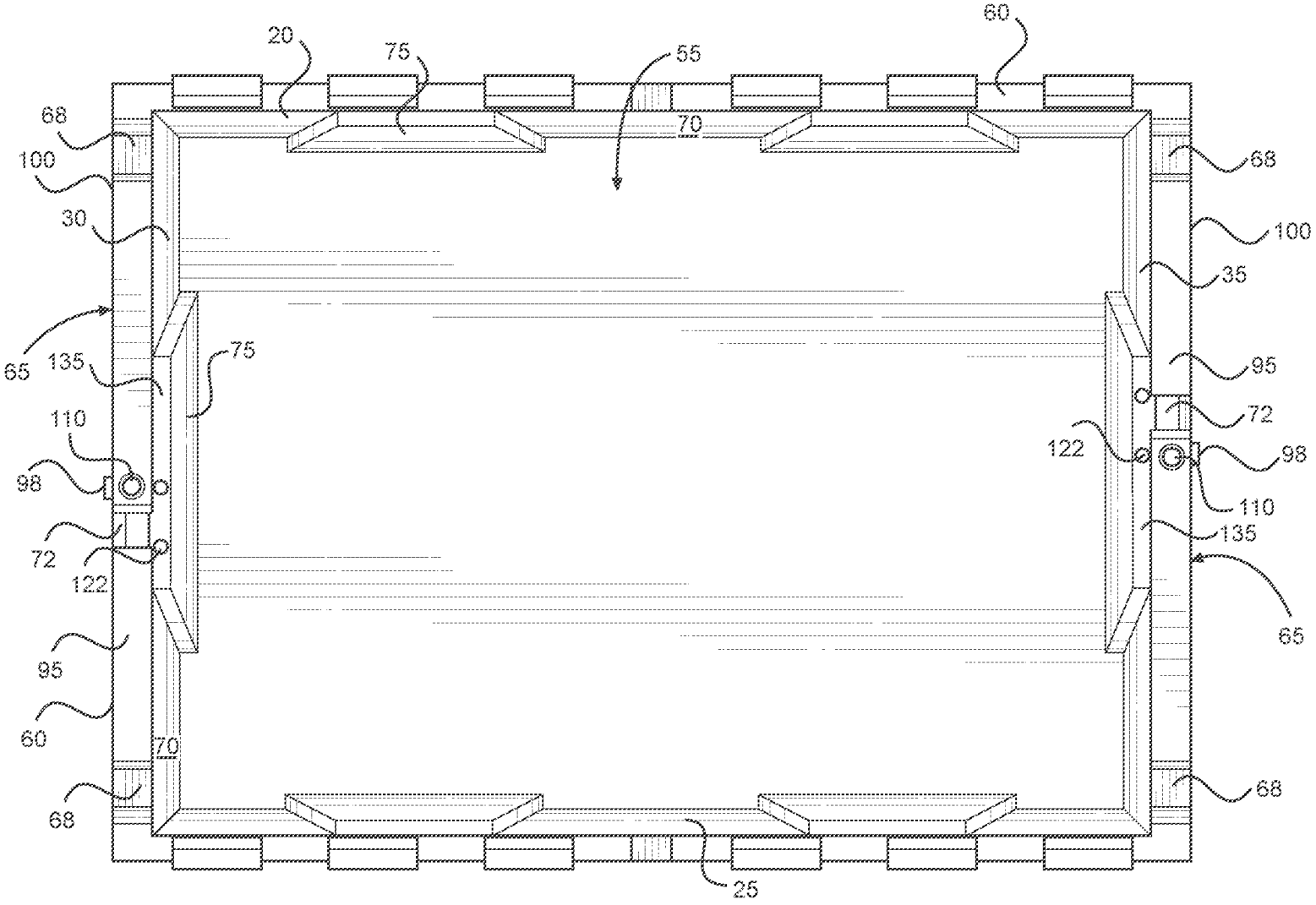
FIG. 5 shows a top plan view of the water resistant tote box without the lid.
Figure 8:
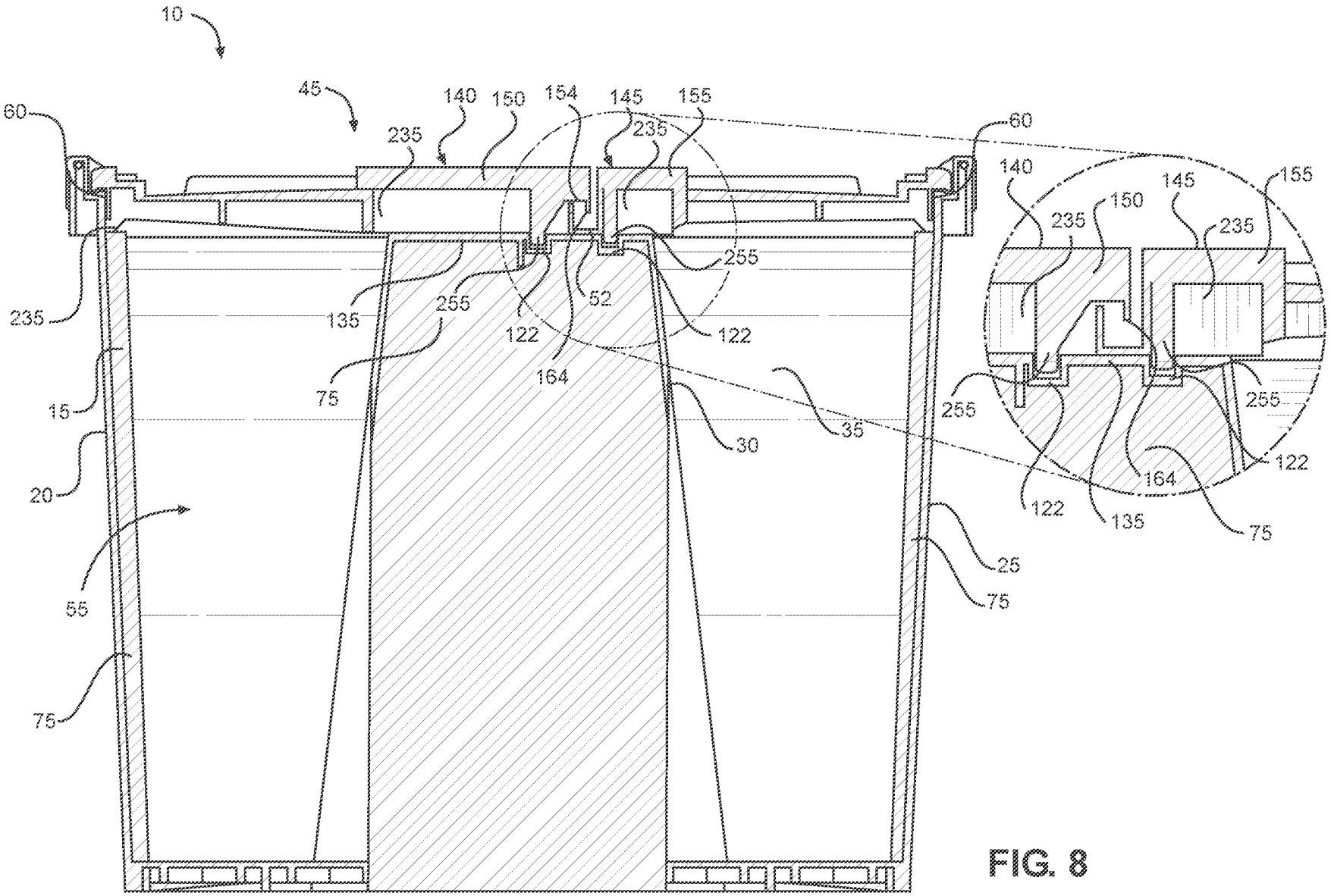
FIG. 8 shows a cross-sectional view of the water resistant tote box along line 8-8 of FIG. 2.

Referring now to FIGS. 3 and 5, there is shown a top perspective view of the water resistant tote box and a top plan view of the tote box without the lid, respectively. The sidewalls 20, 25 and end walls 30, 35 extend vertically, upwardly from a periphery edge of the base 15 and define an interior volume 55 configured to receive and maintain items therein. In one embodiment, the sidewalls 20, 25 and the end walls 30, 35 extend upwardly at an angle from the base 15 and taper outwardly at a certain draft angle from the base 15, such that another tote box 10, or other like tote boxes, may be nestled inside the tote box 10 when the lid is opened or removed. The sidewalls 20, 25 and end walls 30, 35 include upper edges 60 that, conjunctively, define the perimeter of the open upper end 40. The sidewalls 20, 25 and end walls 30, 35 include an interior surface 70 having a plurality of reinforcement shoulders 75 extending vertically, upwardly from the base 15 towards the upper edges 60 of the sidewalls 20, 25 and the end walls, 30, 35. The reinforcement shoulders 75 terminate below the upper edges 60 and protrude laterally inwardly towards the interior volume 55, as shown by FIG. 8. In the depicted embodiment, the reinforcement shoulders 75 include a substantially trapezoidal shape tapering upwardly from the base 15 towards the upper edges 60. The reinforcement shoulders 75 provide the lid 45 support when the lid 45 is closed by bearing weight exerted downwardly onto the lid 45, such as by another tote box 10 stacked thereon, as shown by FIG. 10, and redirecting the weight exerted onto the hinges of the lid 45 to the reinforcement shoulder 75.

Figure 2:
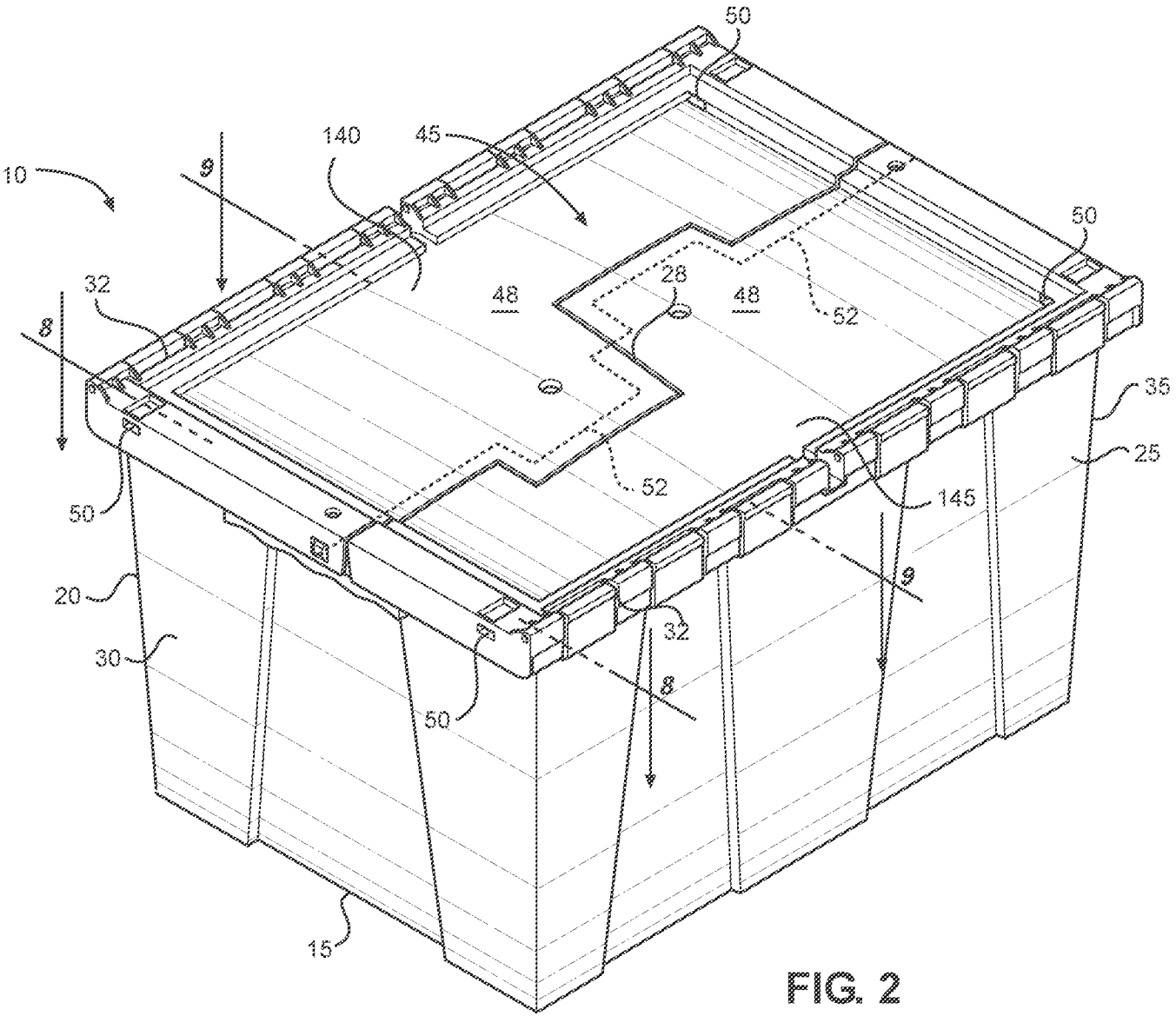
FIG. 2 shows a perspective view of the water resistant tote box in a closed configuration.
Figure 9:
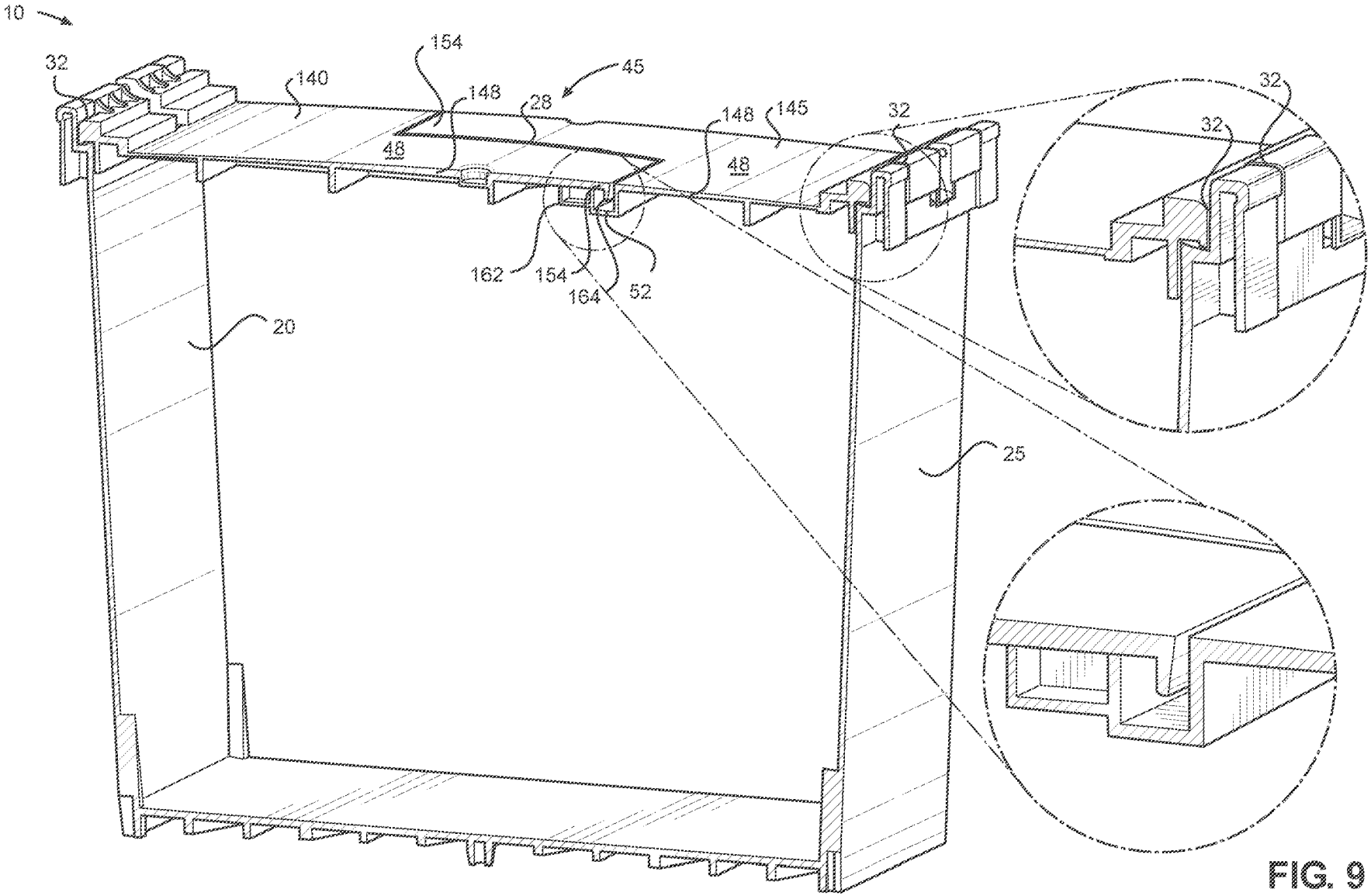
FIG. 9 shows a perspective cross-sectional view of the water resistant tote box along line 9-9 of FIG. 2.

Each of the sidewalls 20, 25 includes a plurality of hinge sockets 80, a plurality of hinge knuckles 85, and a drain trough 90 disposed along the upper edges 60 of the sidewalls 20, 25. The hinge sockets 80 include beveled edges that slant laterally, outwardly and downwardly relative to the interior volume 55. The plurality of hinge knuckles 85 are positioned between the plurality of hinge sockets 80, such that the hinge knuckles 85 and hinge sockets 80 are arranged one after the other along the length of the sidewalls 20, 25. The hinge sockets 80 are configured to receive hinge knuckles disposed on the lid 45, such that the hinge knuckles of the lid 45 secure to the plurality of hinge knuckles 85 at seams 32, as shown in FIGS. 1, 2, and 9. The angled nature of the beveled edges direct moisture, permeating the seams 32, off the top of the tote box 10, thereby adding to the synergistic effect of directing moisture away from the top of the tote box 10.

The plurality of hinge knuckles 85 each include an aperture 88 extending horizontally therethrough. The apertures 88 are configured to receive a hinge pin therethrough. In one embodiment, the sidewalls 20, 25 include corners having beveled edges, and the hinge knuckles 85 are positioned inward of the corners. The drain troughs 90 include recessed or cut-out portions disposed along the upper edges 60 of the sidewalls 20, 25 that extend laterally outwardly from the upper edges 60 through the beveled edges 80 with respect to the interior volume 55. In the depicted embodiment, the drain trough 90 is disposed centrally along the longitudinal length of the sidewalls 20, 25. In one embodiment, the drain trough 90 is slanted or angled outwardly, downwardly relative to the interior volume 55 of the tote box 10. In this way, the drain trough 90 aids in directing moisture away from the top of the tote box 10.

Referring now to FIGS. 3-6, there are shown various view of the water resistant tote box. The end walls 30, 35 include a rim 65 protruding laterally outwardly from the upper edges 60 thereof, a plurality of drain troughs 68, and a drain receptacle 72. The rim 65 includes a first side 95 extending laterally outward from the end walls 30, 35 and a second side 100 extending vertically downward from the first side 95. In the depicted embodiment, the plurality of drain troughs 68 include recessed or cut-out portions disposed along the upper edges 60 of the end walls 30, 35. The drain troughs 68 extend laterally outwardly along the rim 65 relative to the interior volume 55. In alternative embodiments, the plurality of drain troughs 68 include apertures in the upper edges 60 that extend through the rim 65. In the depicted embodiment, each end wall 30, 35 includes a pair of drain troughs, wherein a first drain trough is disposed on one corner of the end walls 30, 35 and a second drain trough is disposed on a second corner of the end walls 30, 35. The drain receptacle 72 includes a recessed or cut-out portion disposed along the upper edge 60 of the end walls 30, 35. The drain receptacle 72 extends laterally outwardly along the rim 68 with respect to the interior volume 55. In one embodiment, the drain receptacles 72 includes a larger or deeper recess sized to receive a portion of the drain gutter of the lid therein. In another embodiment, the drain receptacle 72 includes a lip angled laterally outwardly and downwardly to further facilitate the direction of moisture off of the tote box.

The rim 65 forms a space 105 (or interior portion) between the second side 100 and the end walls 30, 35. A latch tab 98 disposed on the second side 100 of the rim 65 protrudes laterally outwardly therefrom in a first position. The latch tab 98 is configured to catch an aperture disposed on a side of the lid 45, as shown in FIG. 2. The latch tab 98 is depressible laterally inwardly into the space 105 to a second position so as to release the latch tab 98 from the lid 45. The latch tab 98 is biased laterally outwardly towards the first position, such that the latch tab 98 is constantly protruding outwardly from the second side 100 of the rim and in position to catch a catch aperture disposed on the lid 45, as shown in FIG. 2. A lock hole 110 extending through the first side 95 of the rim 65 is sized to receive a fastener, such as a cable tie or padlock, therethrough. In one embodiment, the lock hole 110 is countersunk for facilitating the insertion of fasteners therethrough. A handle 115 extending downwardly from the rim 65 is sized to receive a user's hand therein for lifting, carrying, and transporting the tote box 10. In the depicted embodiment, the handle 115 includes an ergonomic grip having grooves 118 sized to receive the fingers of a user's hand, as shown in FIG. 4.

Figure 6:
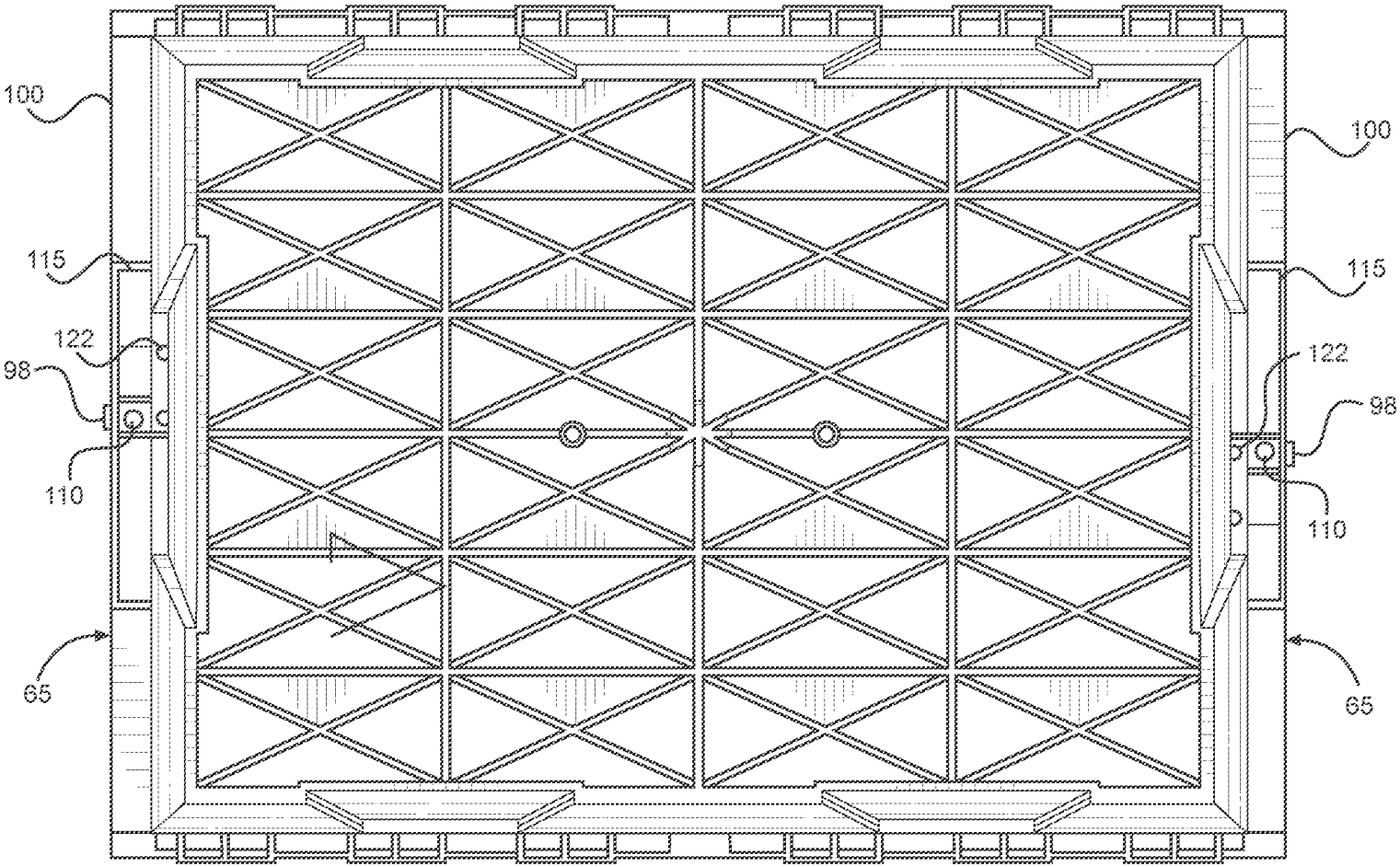
FIG. 6 shows a bottom plan view of the water resistant tote box.
Figure 7A:
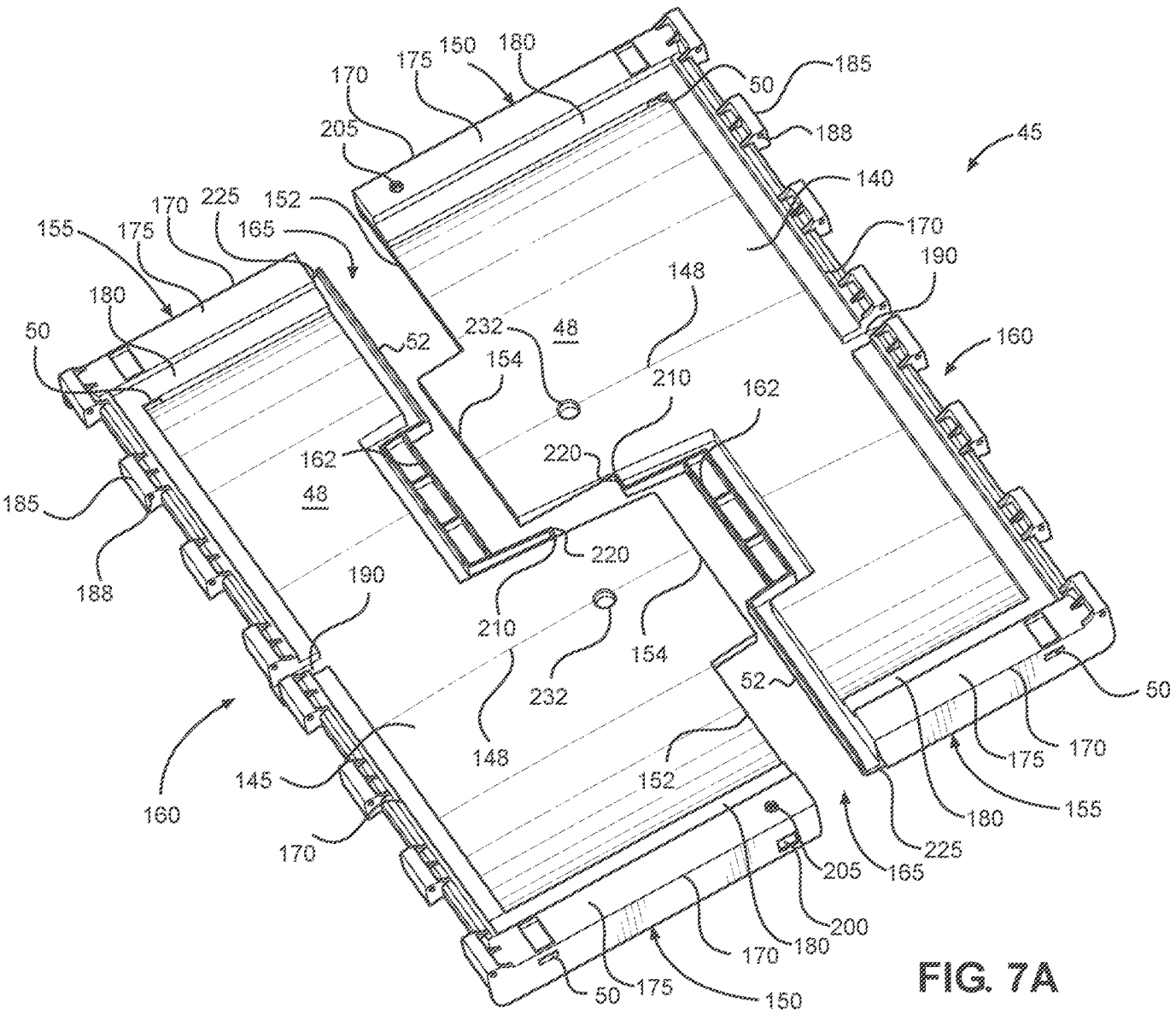
FIG. 7A shows a perspective view of the lid halves of the lid of the water resistant tote box.
Figure 7B:
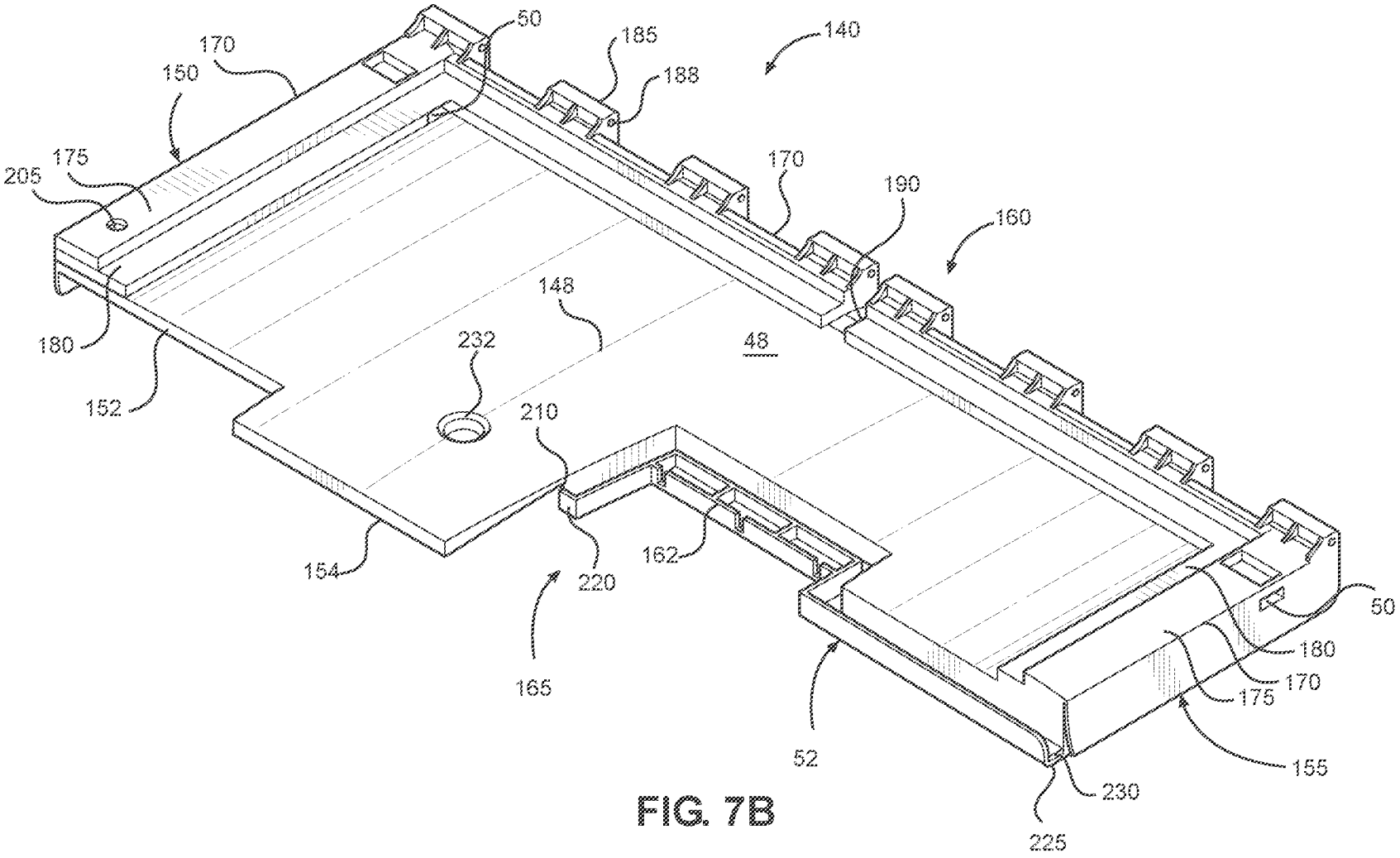
FIG. 7B shows a right perspective view of a lid half of the lid of the water resistant tote box.
Figure 7C:
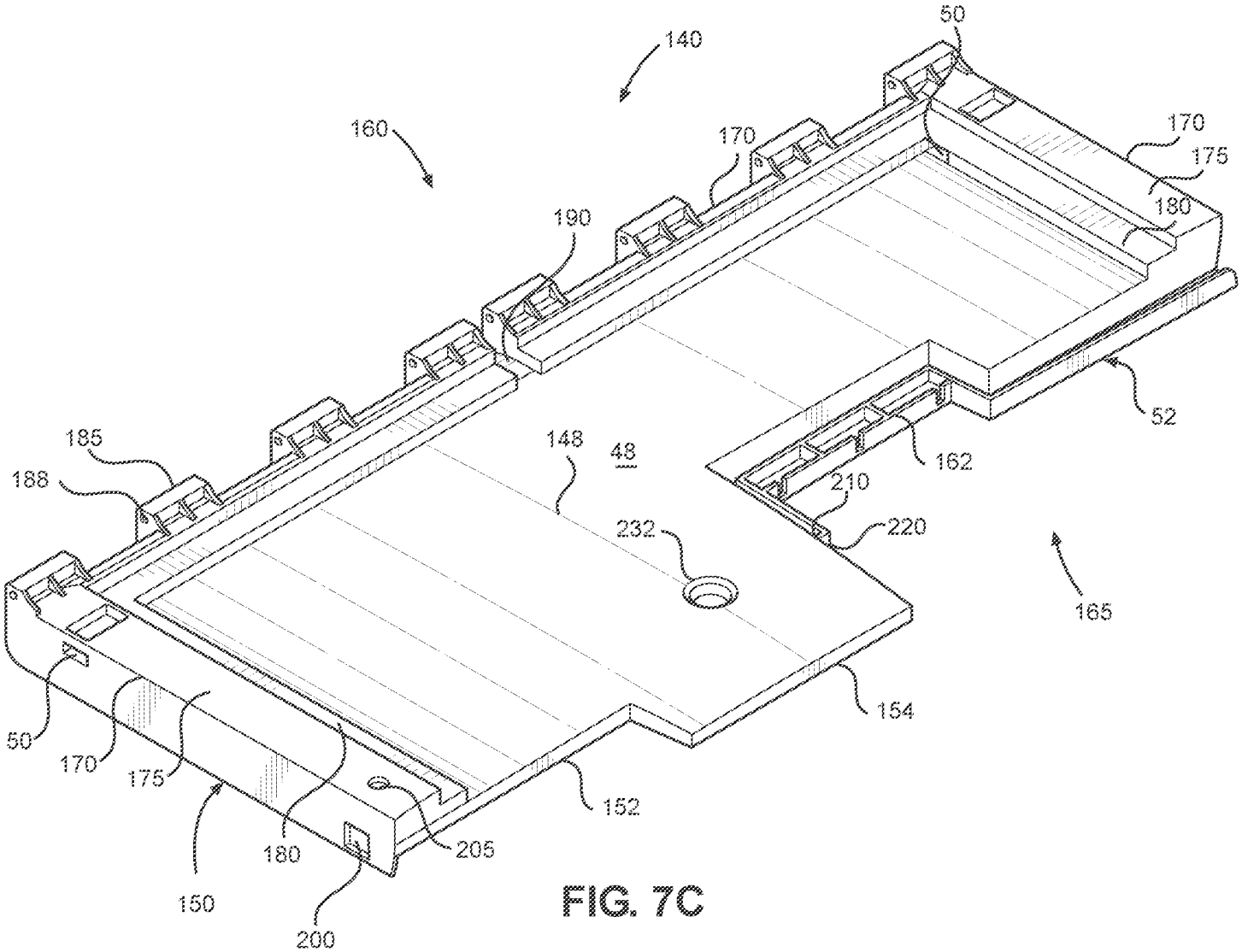
FIG. 7C shows a left perspective view of a lid half of the water resistant tote box.
Figure 7D:
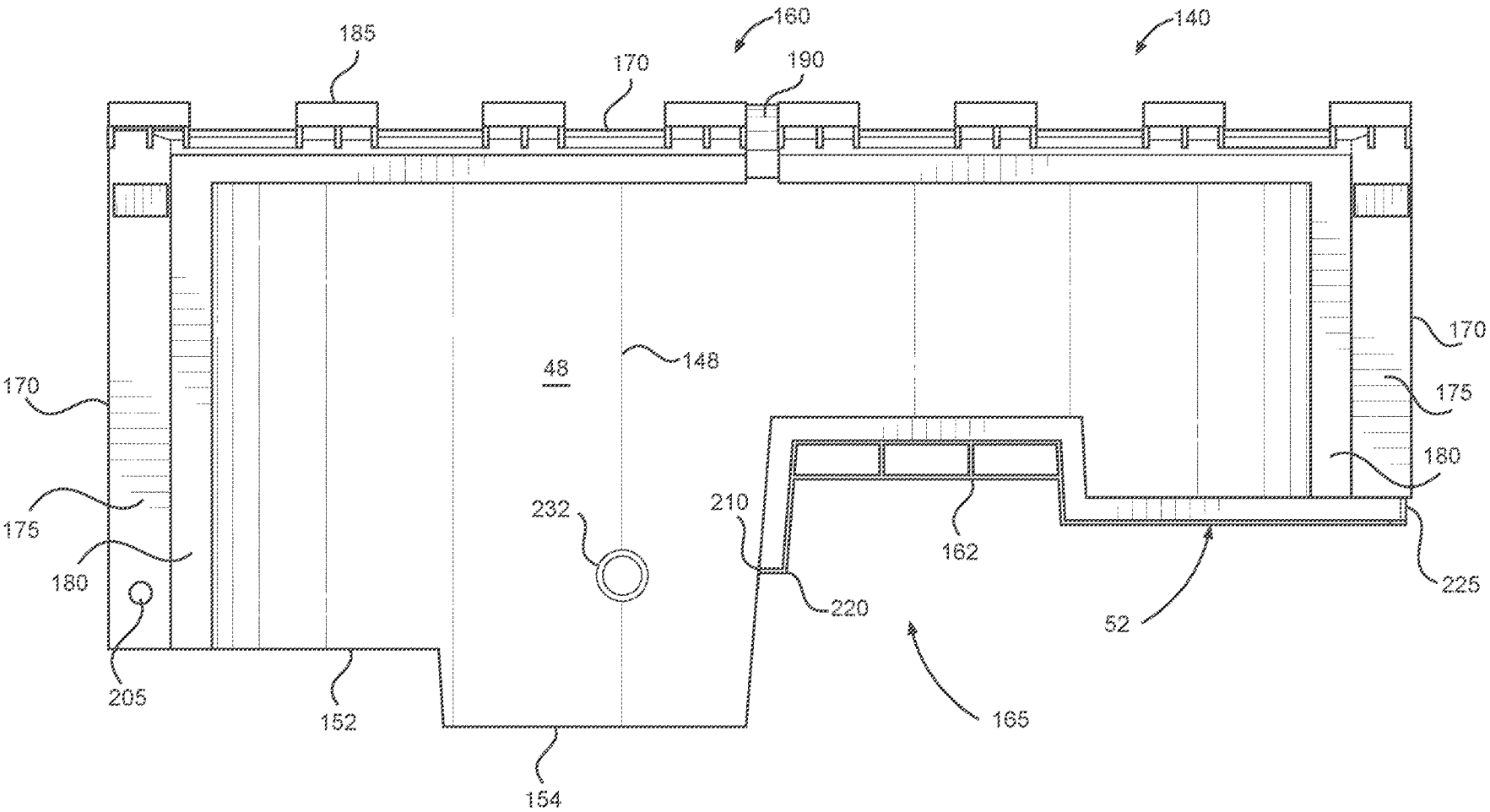
FIG. 7D shows a top plan view of a lid half of the water resistant tote box.
Figure 7E:
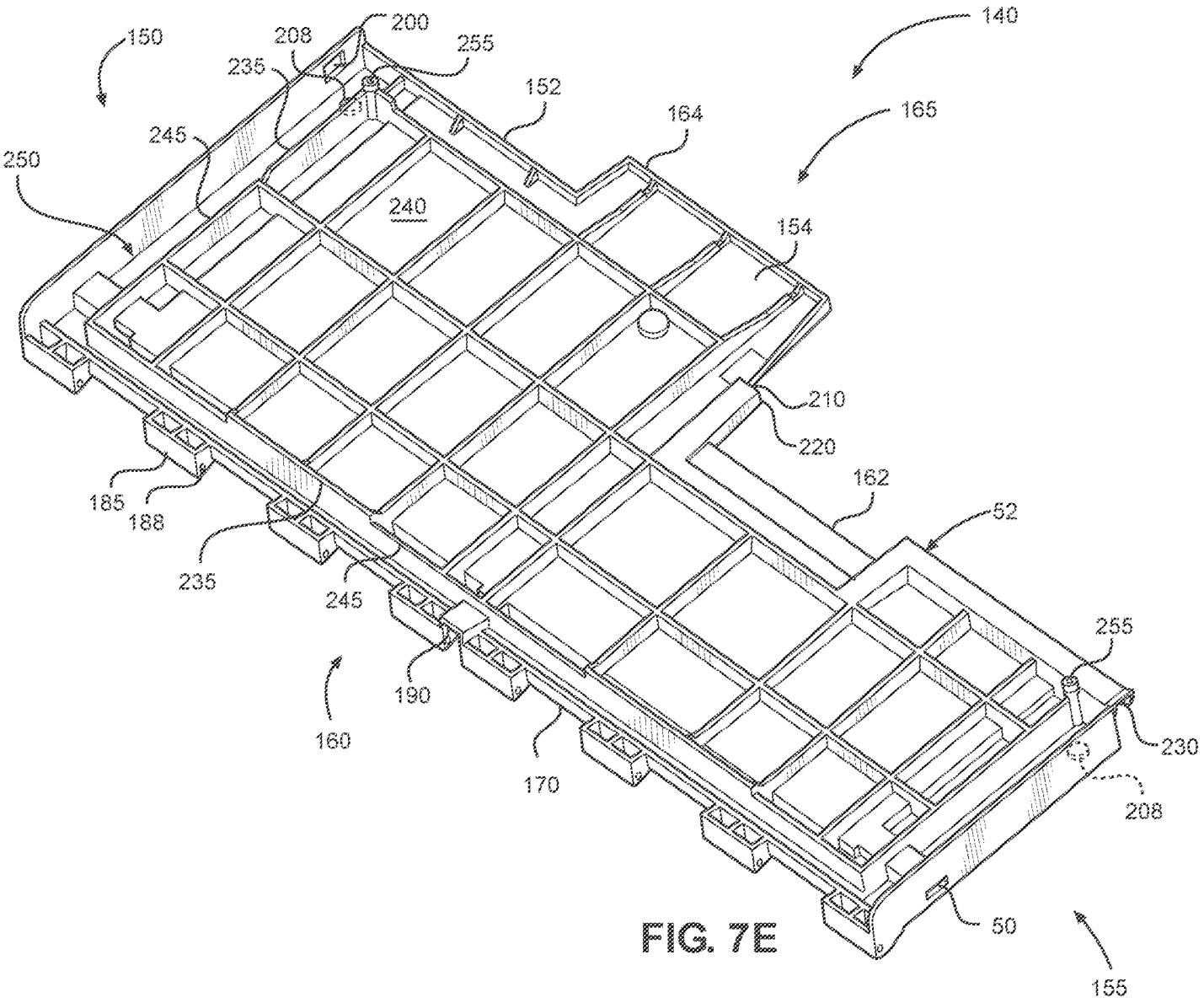
FIG. 7E shows a bottom perspective view of a lid half of the water resistant tote box.

Referring specifically to FIGS. 5, 6 and 8 there are shown top and bottom plan views of the water resistant tote box and a cross-sectional view of the water resistant tote box along line 8-8 of FIG. 2, respectively. The reinforcement shoulders 75 disposed on the interior surface of the end walls 30, 35 include peg cavities 122 configured to receive pegs disposed on a lower surface of the lid 45. The peg cavities 122 are disposed on the upper shoulder surface 135 of the reinforcement shoulders 75 and are sized to receive the pegs of the lid therein. In one embodiment, the peg cavities 122, latch tabs 98, and lock holes 110, are offset relative to a longitudinally extending center axis of the tote box 10.

Figure 4:
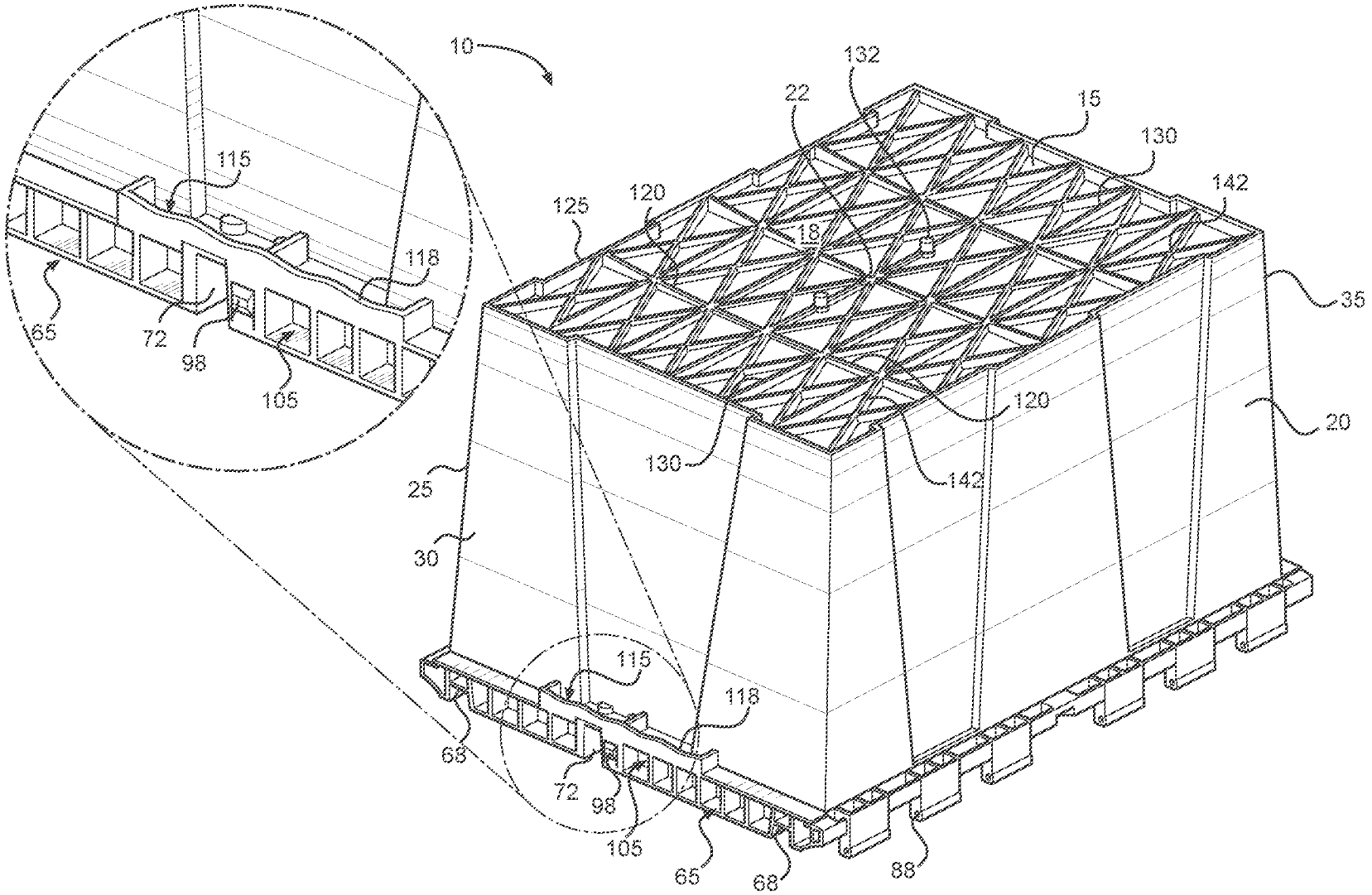
FIG. 4 shows a bottom perspective view of the water resistant tote box with the lid.

Referring specifically to FIG. 4, there is shown a perspective bottom view of the water resistant tote box. The concave lower surface 18 of the base is formed by a plurality of ribs that define an arcuate or concave structure that matches the convex upper surface of the lid. In the depicted embodiment, the concave lower surface 18 is formed by a plurality of laterally extending ribs 120 that taper in height from the perimeter edge 125 towards a longitudinally extending central axis of the base 15 and a plurality of longitudinally extending ribs 130 that taper in height from a perimeter edge 125 of the base 15 towards a laterally extending central axis of the base 15. The tapering of the ribs 120, 130 forms an arcuate structure, as further shown by the cross-sectional views in FIGS. 8, 9, and 11. In another embodiment, the concave lower surface 18 is formed from either of the plurality of longitudinally extending ribs 130 or the plurality of laterally extending ribs 120. In yet another embodiment, the concave lower surface 18 is formed a plurality of diagonally extending ribs 142 that taper in height from the perimeter edge 125 towards a central region of the concave lower surface 18.

The base 15 further includes base pegs 132 extending vertically downwardly from a central region of the concave lower surface 18 of the base 15. The base pegs 132 provide support and reinforcement to the concave lower surface 18 of the tote box 10 when bearing substantial weight. The base pegs 132 extend vertically downwardly from the concave lower surface 18 and align with the perimeter edge 125 of the tote box 10, such that the base pegs 132 and the perimeter edge 125, make contact with a surface on which the tote box has been placed. In this way, the base pegs 132 provide support to the tote box 10 at its center and preserve the structural integrity of the concave lower surface 18 when bearing weight thereon. Further, the base pegs 132 are positioned such that they are in alignment with base peg cavities disposed on the convex upper surface of the lid, as shown by FIG. 11. In this way, when a first tote box 10 is stacked on a second tote box 12, the base pegs 132 of the first tote box 10 align with the base peg cavities of the second tote box 12, such that the base peg cavities may receive the base pegs 132 therein, as shown by FIG. 11.

In one embodiment, the base 15 further includes a recessed portion 22 sized to receive a seal of a bottom tote box when the tote box 10 is stacked thereon. In the depicted embodiment, the recessed portion 22 is disposed in the center of the base 15, such that it is in alignment with the center of the concave upper surface of the lid.

Referring now to FIGS. 7A-7E, there are shown various views of the lid of the water resistant tote box. The two-piece lid 45 includes a first lid half 140 and a second lid half 145 that are hingedly attached to the upper edges of respective longitudinally extending sidewalls 20, 25, as further shown by FIGS. 1, 2, 8, and 9. The lid halves 140, 145 oppose one another and are complimentary insofar as their inner perimeter edges 152 and interlocking flaps 154 include the same shape and size, but are positioned in opposing orientations, as further shown in FIGS. 1, 2, and 9. In this way, the lid halves 140, 145 engage one another at their respective inner perimeter edges 152 and interlocking flaps 154, such that they fit one another in jigsaw fashion and define the line of connection 28 when closed over the open upper end 40 of the tote box, as shown in FIGS. 2 and 9. Further, the lid halves 140, 145 are complimentary insofar as they, conjunctively, form the convex upper surface 48 of the lid 45, when the lid 45 is secured.

Each lid half 140, 145 includes an arch 148 that crowns or culminates, with respect to the tote box interior volume, at their inner perimeter edges 152, such that the lid halves 140, 145 include surfaces that slope upwards toward the center of each respective lid half 140, 145, as further shown in FIGS. 8, 9, and 11. The arches 148, thus, form a half of the convexity, or outward curvature, of the convex upper surface 48, such that when the inner perimeter edges 152 meet when the lid halves 140, 145 are secured to the tote box along the line of connection, the arches 148 form the complete convex upper surface 48 of the tote box. In this way, the convex upper surface 48 forms a convexity at a central region of the convex upper surface 48 that facilitates the directing of the moisture away from the top of the tote box.

The lid halves 140, 145 include a pair of opposing sides, a rear end 160, and a free side 165. The pair of opposing sides include a first side 150 including a drain channel 50, a catch 200, and a drain hole 205, and a second side 155 including a drain channel 50. The rear end 160 includes a drain trough 190. When the lid halves 140, 145 are secured to the tote box, the drain troughs 190 and drain channels 50 are in fluid communication with the drain troughs of the sidewalls and the drain troughs of the end walls of the tote box, respectively, as shown in FIG. 2. In this way, the drain troughs 190 and drain channels 50 of the lid 45, conjunctively, direct moisture away from the upper surface of the tote box 10 towards the sidewalls and end walls.

An outer perimeter edge 170 extends along the pair of opposing sides 150, 155, while the inner perimeter edge 152 extends along the free side 165. A plurality of hinge knuckles 185 disposed along the outer perimeter edge 170 of the rear end 160 are complimentary to the hinge knuckles disposed on the sidewalls of the tote box insofar as the hinge knuckles 185 fit in the hinge sockets adjacent to the hinge knuckles of the sidewalls and align therewith. Each of the plurality of hinge knuckles 185 include apertures 188 extending horizontally therethrough for receiving a hinge pin. The apertures on the hinge knuckles 185 are complimentary to and aligned with the apertures of the hinge knuckles of the sidewalls, such that when mounted onto their respective sidewalls, the lid halves 140, 145 can be secured to the open upper end of the tote box by securing a hinge pin within the apertures of the complimentary hinge knuckles.

In the depicted embodiment, the lid halves 140, 145 each include a drain trough 190 disposed along a center of an outer perimeter edge 170 of the lid 45. The drain troughs 190 are sized to fit within the drain trough of the sidewalls in order to direct moisture off of the convex upper surface 48 of the tote box. Further, in the depicted embodiment, the drain channels 50 are positioned in a portion of the opposing side walls 150, 155 that are immediately adjacent to the upper corners of the lid halves 140, 145, or the corners between the opposing sides 150, 155 and the rear end 160 of the lid halves 140, 145.

The catch 200 is disposed on an exterior of the first side 150 and is aligned with and complimentary to the latch tab of the end walls. The catch 200 is sized to receive and fasten the latch tab therein, such that the catch 200 fastens the first side 150 to its respective end wall. The drain hole 205 is aligned with and complimentary to the lock hole of the end walls. The drain holes 205 extend through the lid 45 and include a protuberance 208 extending outwardly from the lower surface 240 of the lid and sized to be received by the lock holes. When the lid halves 140, 145 are secured to the tote box, the drain holes 205 align with the lock hole such that the lock holes receive the protuberances 208 therein. In this way, moisture flowing through the drain holes 205 flows directly through the lock hole and off the side of the tote box, without permeating any crevice formed between the drain holes 205 and lock holes and leaking into the interior of the tote box. Moreover, in this position the drain holes 205 and lock holes are configured to receive a fastener therethrough for locking the lid 45 to the tote box.

A drain gutter 52 disposed on the free side 165 of the tote box extends longitudinally along the inner perimeter edge 152 towards the outer perimeter edge 170. The drain gutter 52 defines a recessed channel that includes sidewalls and protrudes outwardly from the inner perimeter edge 152. When the lid halves 140, 145 are secured to the tote box, the interlocking flaps 154 include a lip 164 that overlaps onto a shelf 162 of the opposing lid half, as shown by FIG. 9. The shelf 162 is adjacent to the drain gutters 52 such that the lip 164 is received by the drain gutter 52 and the drain gutter 52 extends underneath the interlocking flap of the opposing lid half, as shown by FIGS. 8 and 9.

In the depicted embodiment, the drain gutters 52 begin at a midway point 210 along the inner perimeter edges 152 of the lid halves 140, 145, such that they are adjacent to their respective interlocking flaps 154. The drain gutters 52 extend in an opposing direction from the interlocking flap on their respective inner perimeter edge 152, such that when the lid halves 140, 145 are secured to the tote box, the inner ends 220 of the drain gutters 52 of each lid half 140, 145 meet and extend in opposing directions underneath the entire line of connection 28, as shown in FIG. 2. In this way, the drain gutters 52 are in position to capture moisture permeating the line of connection. The drain gutter 52 extends or slopes downwardly at an angle along the inner perimeter edge 152 towards the outer perimeter edge 170. In this way, the moisture captured by the drain gutter 52 is directed away from the center of the tote box towards the end walls via gravity.

The drain gutter 52 includes the inner closed end 220 and an outer open end 225. The inner closed end 220 is closed to in order to prevent moisture permeating the line of connection to leak into the interior volume of the tote box. The outer open end 225 enables moisture to flow out of the drain gutter 52 and is sized to fit within the drain receptacle of the end walls. In this way, moisture flowing down the drain gutter 52 is emptied out of the drain receptacle and off the tote box. In one embodiment, the outer open end 225 includes a lip 230 that angles downwardly, further facilitating the directing of moisture away from and out of the drain gutter 52 and off of the tote box. In another embodiment, the inner closed ends of the drain gutters 52 include upwardly tapering walls that abut each other when the interlocking flaps 154 overlap and the lid halves 140, 145 are closed, such that they friction fit to help prevent moisture from permeating the drain gutters 52 and leaking into the interior volume of the tote box.

An outer shelf 175 and an inner shelf 180 disposed on the upper convex surface 48 extend along the outer perimeter edge 170. The outer and inner shelves 175, 180 are tiered with respect to each other and the convex upper surface 48 of the lid 45, such that the inner shelf 180, the outer shelf 175, and the convex upper surface 48 lie on separate and distinct horizontal planes relative to the base when the lid is in a closed configuration. The inner shelf 180 is positioned inward of the outer shelf 175 and includes a height less than the height of the outer shelf 175, such that the outer and inner shelves 175, 180 are tiered laterally outwardly with respect to the convex upper surface 48. In one embodiment, the inner shelf 180 includes a height of a quarter inch. In another embodiment, the inner shelf 180 includes a height greater than or equal to the height of a peak, or apex, of the convex upper surface 48. The inner shelf 180 of the tote box is configured to receive the base of another like tote box, such that the perimeter edge of the base rests thereon, while the outer shelf 175 prevents the stacked tote box from slipping laterally off the inner shelf 180. In this way, the base 15 does not rest directly on the convex upper surface 48 of the lid 45, but rather on the inner shelf 180 itself, which facilitates the distribution of weight towards the sidewalls and end walls of the tote box.

Further, when a first tote box 10 is stacked on the inner shelf 180 of a second tote box 12, the inner shelf 180, in conjunction with the convex upper surface 48 of the lid of the second tote box 12 and the concave lower surface of the base of the first tote box 10, forms a space 14 in between the convex upper surface 48 and the concave lower surface, as shown in FIG. 11. The space provides room for the base of the first tote box to move downwardly, when bearing weight, before making contact with the convex upper surface 48. In operation, the space prevents a stacked tote box from immediately exerting a downward force directly onto the convex upper surface 48 of the tote box on which it is stacked. A downward force applied to the convex upper surface 48 would tend to flatten the convexity of the convex upper surface, thereby preventing moisture, permeating the line of connection, from flowing down the sloping drain gutter 52 towards the end walls of the tote box. Therefore, the space prevents the aforementioned effect.

Base peg cavities 232 disposed on each lid half 140, 145 are positioned on a center portion of the lid halves 140, 145. The alignment and position of the base peg cavities 232 corresponds to the alignment and position of the base pegs, such that the base peg cavities 232 of a tote box are sized and configured to receive the base pegs of the concave lower surface of another like tote box stacked thereon, as shown in FIG. 11. In operation, the base peg cavities 232 provide a recessed area in which the base pegs of an upper tote box may descend into after the weight of the tote box has caused its concave lower surface to give or stretch downwardly within the space formed between the convex upper surface 48 of the lid 45 of the lower tote box and the concave lower surface of the base of the upper tote box. In this way, the base peg cavities 232 prevent the base pegs from making contact with the convex upper surface 48 of the lid 45 and flattening the convexity thereof.

A plurality of reinforcement ribs 235 disposed on the lower surface 240 of the lid halves 140, 145 are positioned along an inner periphery edge 245 of the lower surface 240. The inner periphery edge 245 extends along the opposing sides 150, 155 and the rear end 160 of the lid halves 140, 145. The plurality of reinforcement ribs 235 include raised or protruding portions that protrude vertically outwardly from the inner periphery edge 245 relative to the lower surface 240 of the lid halves 140, 145. The reinforcement ribs 235 are aligned with and correspond to the reinforcement shoulders of the interior surfaces of the sidewalls and end walls of the tote box, such that when the lid halves 140, 145 are secured to the tote box, the reinforcement ribs 235 contact the reinforcement shoulders and rest thereon, as shown by FIG. 8. The reinforcement ribs 235 provide support to the convex upper surface 48 of the lid 45, such that weight bearing down on the lid 45 is distributed from the inner shelf 180 towards the sidewalls and end walls of the tote box. In this way, the reinforcement ribs 235 prevent the flattening of the convexity of the convex upper surface 48, by offsetting any downward force exerted onto the tote box with an upward force formed by the interaction of the reinforcement ribs 235 with the reinforcement shoulders.

A canal 250 disposed on the lower surface of the lid halves 140, 145 extends between and along the inner periphery edge 245, the opposing sides 150, 155, and the rear end 160 of the lid halves 140, 145. The canal 250 is sized to receive the rims of the end walls flush therein, such that the lid 45 can rest level relative to the tote box when the lid is secured 45, as shown by FIGS. 2 and 8. Pegs 255 disposed on the opposing sides 150, 155 and on the lower surface 240 are configured to engage the peg cavities 122 disposed on the reinforcement shoulders of the interior surface of the end walls, as shown by FIG. 8. The pegs 255 protrude vertically outwardly relative to the lower surface 240. In one embodiment, the pegs 255 include a tapered end sized to fit into the peg cavities 122. In another embodiment, the pegs 255 friction fit into the peg cavities 122. In the depicted embodiment, the lid halves include a pair of pegs 255 disposed on opposing sides 150, 155 and on an end of the reinforcement ribs 235. A first peg is disposed on a corner of the first side 150 adjacent to the inner perimeter edge 152 and the second peg is disposed a corner of the second side 155 adjacent to the inner perimeter edge 152. The pegs 255 are configured to engage the peg cavities 122 when the lid halves 140, 145 are secured to the tote box, further providing a means for fastening the lid 45 to the tote box and providing reinforcement to the lid 45 on the reinforcement shoulders.

Figure 12:
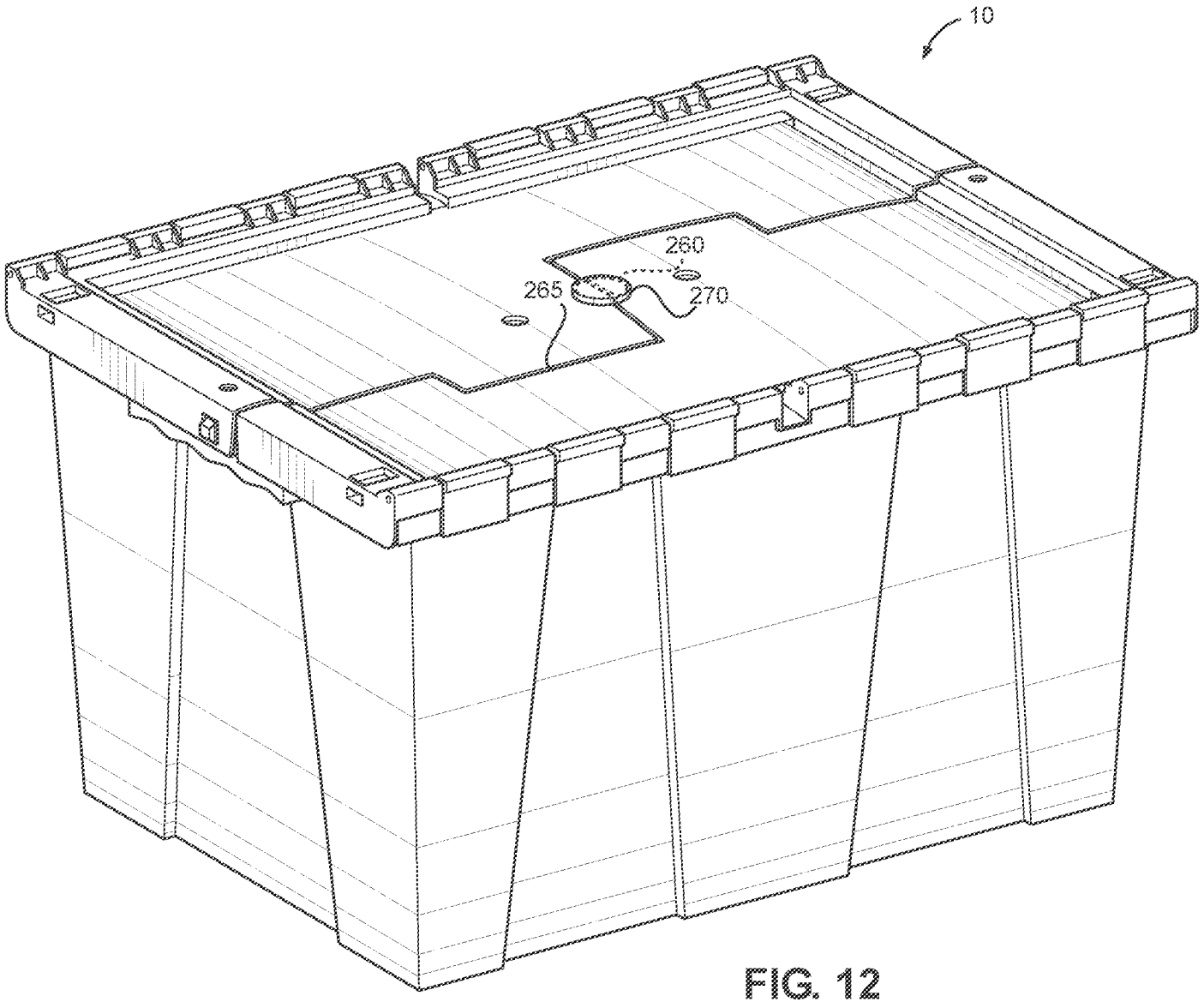
FIG. 12 shows a perspective view of the water resistant tote box according to an alternative embodiment.
Figure 13:
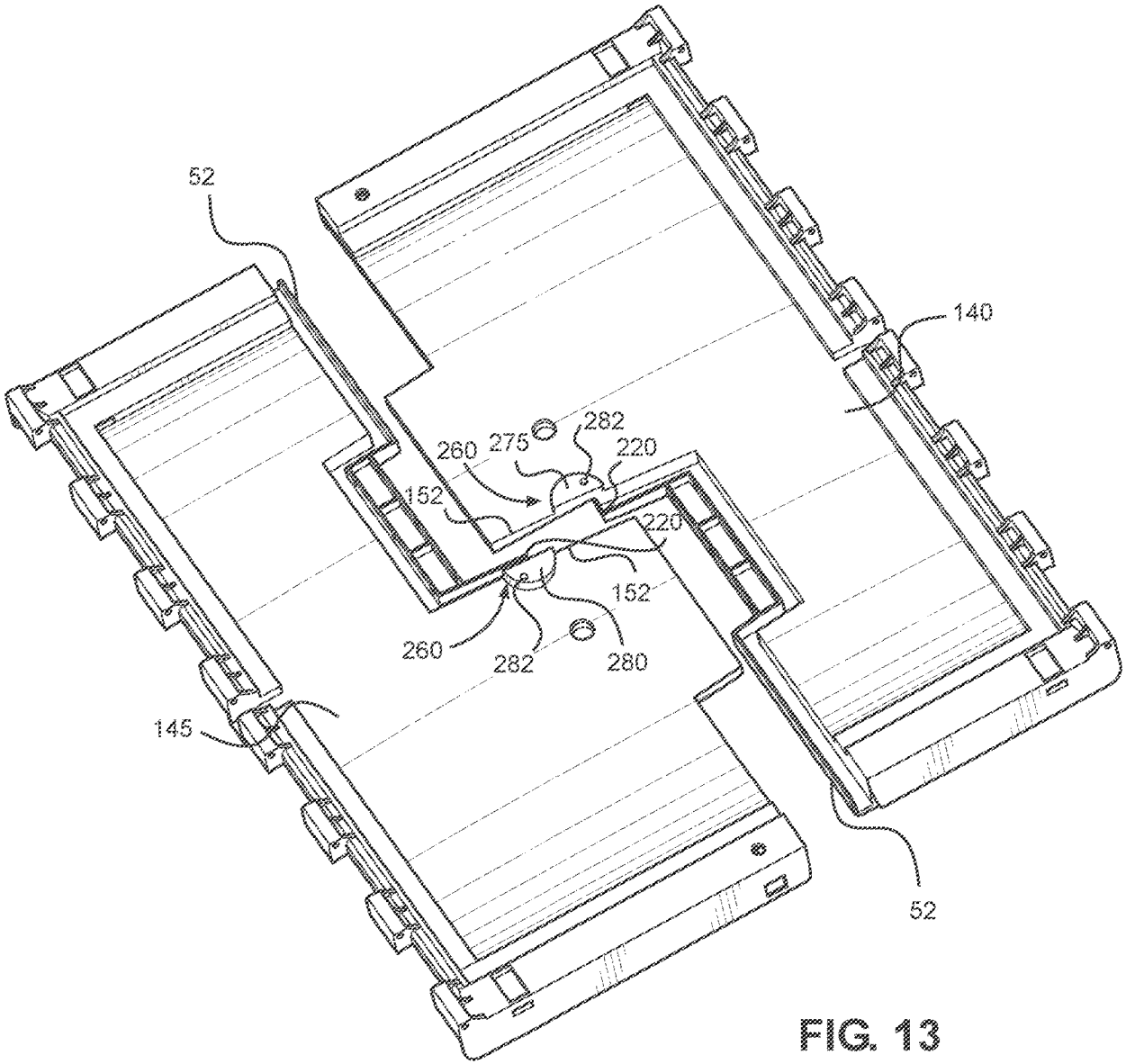
FIG. 13 shows a perspective view of the lid halves of the lid of the water resistant tote box lid according to an alternative embodiment.
Figure 15:
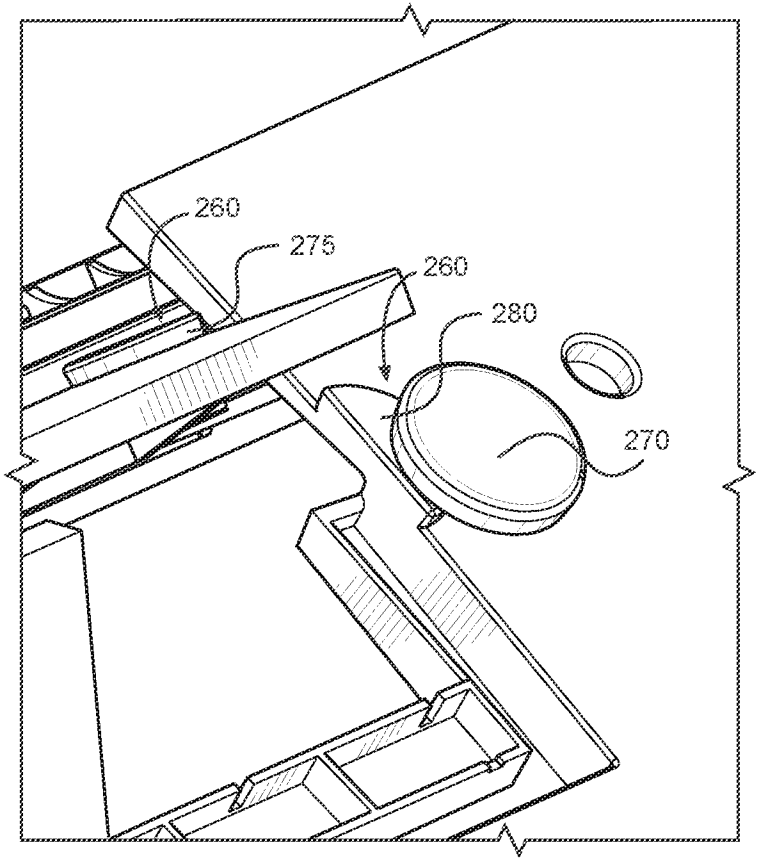
FIG. 15 shows a close up view of the seal affixed to and pivoted away from the raised area of the lid onto the tote box lid halves.

Referring now to FIGS. 12 and 13, there is shown a perspective view of the water resistant tote box and a top plan view of the lid of the water resistant tote box, respectively, according to an alternative embodiment of the present invention. In an alternative embodiment, the tote box 10 includes a raised area 260 disposed along the line of connection 265 that is configured to receive a seal 270 for further preventing moisture from permeating the line of connection 265. The raised area 260 includes a first portion 275 disposed on the first lid half 140, a second portion 280 disposed on the second lid half 145, and an aperture 282. The first and second portions 275, 280 are disposed along the inner perimeter edges 152 of their respective lid halves 140, 145 adjacent to the drain gutters 52, as shown in FIG. 13. The aperture 282 is disposed on the either of the first portion 275 or the second portion 280, or both. In operation, the aperture 282 is configured to receive a retaining tab disposed on the seal 270 therethrough, which rotatably couples the seal 270 to the raised area 260, as shown by FIG. 15.

In the depicted embodiment, the first and second portions 275, 280 are positioned midway along the inner perimeter edges 152 immediately above the ends 220 of the drain gutters 52, such that when the lid halves 140, 145 are secured to the tote box 10, the first and second portions 275, 280 align and form the raised area 260 directly above the point at which the ends 220 of the drain gutters 52 meet. In this way, when the seal 270 is mounted onto the raised area 260, the seal 270 covers the area where the drain gutters 52 meet in order to prevent moisture, permeating the line of connection 265, from leaking through that point. The raised area 260 protrudes vertically, outwardly from the convex upper surface 48. In the depicted embodiment, the first and second portions 275, 280 forms raised semi-circular projections, such that when the lids halves 140, 145 are secured to the tote box 10, they form a form a circular raised area 260.

Figure 14B:
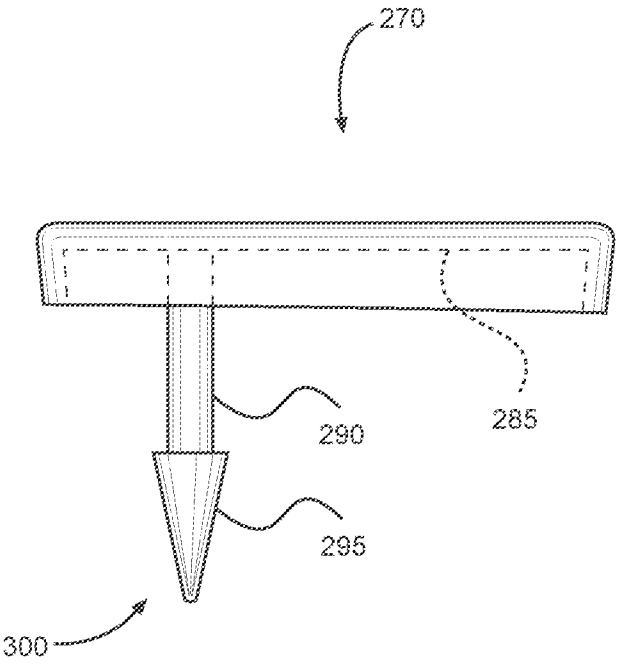
FIG. 14B shows a side view of the seal of the water resistant tote box according to an alternative embodiment.
Figure 14A:
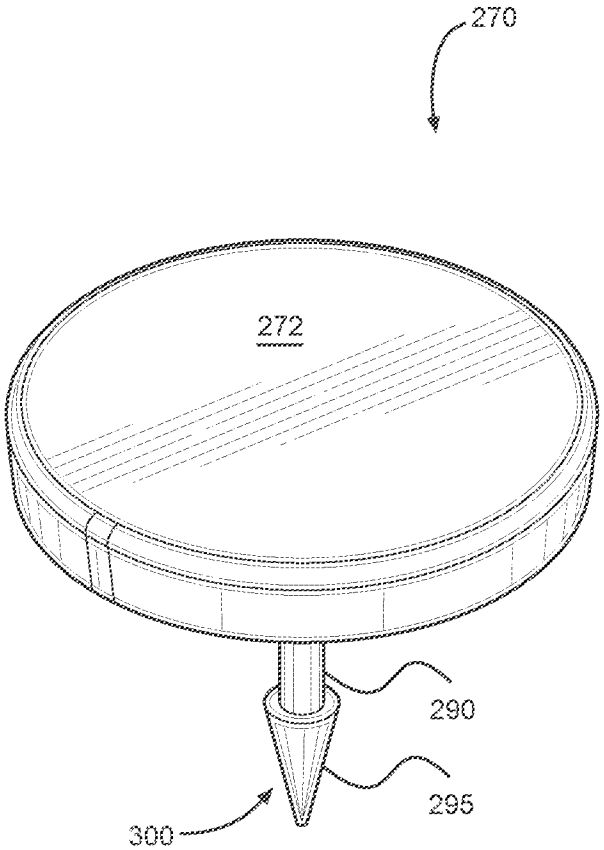
FIG. 14A shows a perspective view of the seal of the water resistant tote box according to an alternative embodiment.

Referring now to FIGS. 14A and 14B, there is shown a perspective and side view of the seal of the water resistant tote box according to an alternative embodiment of the present invention. The seal 270 includes a water impermeable upper surface 272 configured to prevent moisture from permeating therethrough, such that when positioned over the raised area of the upper surface of the lid, the seal 270 prevents moisture from permeating the line of connection above the point at which the drain gutters meet. In this way, the seal 270 serves as an extra measure for preventing moisture from leaking into the interior of the tote box.

The seal 270 includes a size configured to fit within the recessed portion of the base of the tote box, such that the upper surface 272 of the seal 270 is aligned flush with the upper perimeter of the recessed portion. In this way, the balance of a tote box stacked on another like tote box, which includes the seal 270, is not impaired or uneven due to the protruding seal 270. The seal 270 includes a hollowed interior 285 sized to receive the raised area of the tote box, and a retaining tab 290 sized to be inserted into the aperture of the raised area. The retaining tab 290 protrudes vertically outwardly relative to the hollowed interior 285 of the seal 270. When inserted to the aperture of the raised area, the retaining tab 290 rotatably couples the seal 270 to either the first or second portions of the raised area. In this way, the seal 260 may remain coupled to either the first or second portion when freed from the raised area, as shown by FIG. 15.

In the depicted embodiment, the retaining tab 290 includes a stopper 295 disposed at a distal end 300. The stopper 295 includes a projection flaring outwardly relative to the retaining tab 290 that prevents the retaining tab 290 from sliding out from the aperture when inserted therein. In this way, the stopper 295 fastens the retaining tab 290 into the aperture of the raised area, such that the seal 270 does not come loose from the raised area when in use. In one embodiment, retaining tab 290 includes a length greater than the length of the raised area, such that the retaining tab 290 may fully traverse the aperture and adequately fasten the seal 270 to the raised area.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tote box, comprising:

a base including a concave lower surface;

a wall extending upwardly from the base;

a lid including a plurality of lid sections hingedly connected to the wall, the plurality of lid sections including interlocking flaps, the plurality of lid sections securable at a line of connection via the interlocking flaps, the plurality of lid sections including arcuate surfaces that conjunctively define a convex upper surface on the lid when the plurality of lid sections are secured at the line of connection, the convex upper surface configured to direct moisture towards the walls;

wherein the convex upper surface corresponds to the concave lower surface of the base.

2. The tote box of claim 1, wherein the lid includes an inner shelf when secured at the line of connection, the inner shelf extending around a perimeter edge of the lid and raised upwardly relative to the convex upper surface, wherein the inner shelf is configured to receive the base of a like tote box.

3. The tote box of claim 2, wherein the raised inner shelf is configured to form a space between the concave lower surface of the base of a first tote box and the convex upper surface of the lid of a second tote box on which the inner shelf is disposed, when the first tote box is stacked on the second tote box, the space configured to prevent the base of the first tote box from exerting a downward force onto the convex upper surface of the second tote box and flattening the convexity thereof.

4. The tote box of claim 2, wherein the raised inner shelf includes a height greater than or equal to the height of an apex of the convex upper surface.

5. The tote box of claim 1, wherein the base includes a peg protruding therefrom, the peg including a height equal to a height of the perimeter edge of the base.

6. The tote box of claim 5, wherein the lid includes a peg hole, the peg hole including a diameter greater than the diameter of the peg and a depth greater than the height of the peg, the peg hole aligned with the peg such that the peg hole is configured to receive the peg of another tote box therein.

7. The tote box of claim 1, wherein the concave lower surface of the base is formed by a plurality of longitudinally extending ribs tapering in height from a perimeter edge of the base towards a laterally extending center axis of the base.

8. The tote box of claim 1, wherein the concave lower surface of the base is formed by a plurality of laterally extending ribs tapering in height from a perimeter edge of the base towards a longitudinally extending center axis of the base.

9. The box of claim 1, wherein the concave lower surface includes a recessed portion in a center thereof configured to receive a seal of another tote box.

10. The tote box of claim 1, wherein the plurality of lid sections include a lower surface having a plurality of ribs protruding vertically outwardly therefrom, wherein the plurality of ribs engage the shoulders when the plurality of lid sections are secured.

11. The tote box of claim 10, wherein the plurality of ribs are disposed on a periphery edge extending about a first side, rear end, and second side of the lower surface of the lid halves, the ribs extending outwardly therefrom at spaced intervals, wherein the first side, rear end, and second side include a rib.

12. A tote box, comprising:

a base including a concave lower surface;

a pair of longitudinally extending sidewalls extending upwardly from the base;

a pair of laterally extending end walls extending upwardly from the base;

wherein the sidewalls and end walls include an upper edge;

wherein the sidewalls and end walls include a plurality of reinforcement shoulders extending inwardly therefrom;

a lid including a convex upper surface, the lid including a pair of lid halves including a rear end hingedly connected to the longitudinally extending sidewalls, a first side, a second side, a free end opposing the rear end, and a lower surface;

wherein the rear end, first side, and second side define an outer perimeter edge and the free end defines an inner perimeter edge;

an interlocking flap disposed on the inner perimeter edge, the lid halves securable at a line of connection via their respective interlocking flaps;

a drain gutter extending longitudinally along the inner perimeter edge towards the outer perimeter edge, the drain gutter protruding outwardly from the inner perimeter edge;

wherein the interlocking flap of a lid half overlaps the drain gutter disposed on the opposing lid half when the lid halves are secured at the line of connection;

wherein the drain gutter extends underneath the line of connection when the lid halves are secured;

an inner shelf disposed around a perimeter edge of the lid, the inner shelf protruding vertically upwards relative to the convex upper surface of the lid;

reinforcement ribs extending around a lower periphery edge of the lower surface of the lid, the reinforcement ribs protruding vertically outwardly therefrom;

wherein the reinforcement ribs are aligned with the reinforcement shoulders of the sidewalls and end walls, such that the reinforcement ribs engage the reinforcement shoulder when the lid halves are secured.

13. The tote box of claim 12, wherein the pair of lid halves include arched surfaces that define the convex upper surface of the lid when the pair of lid halves are secured.

14. The tote box of claim 12, wherein the pair of lid halves include the same shape and size and are positioned in opposing orientations with respect to one another.

15. The tote box of claim 12, wherein the inner shelf includes a perimeter greater than or equal to the perimeter of a perimeter edge of the base.

16. The tote box of claim 12, wherein the sidewalls include beveled hinge sockets configured to receive hinge knuckles disposed in the lid, the beveled edges sloping laterally outwardly.

17. The tote box of claim 12, wherein the end walls comprise a drain receptacle sized to receive an end of the drain gutters therein.

18. The tote box of claim 17, wherein the drain gutters of each lid half extend in opposing directions underneath the line of connection when the lid halves are secured at the line of connection.

19. The tote box of claim 12, wherein the end walls include a rim having a depressible latch tab protruding laterally outwardly therefrom, the latch tab biased laterally outwardly and configured to catch an aperture on the first side and second side of the lid.

20. The tote box of claim 19, wherein the rim includes a lock hole configured to receive a fastener therethrough.

21. The tote box of claim 20, further comprising a drain hole disposed on the lid halves, the drain hole in communication with the lock hole, when the lid halves are secured.

22. The tote box of claim 21, wherein the drain hole includes a protuberance extending outwardly from the lower surface of the lid.

23. The tote box of claim 22, wherein the lock hole is aligned with the protuberance and configured to receive the protuberance when the lid halves are secured.

24. The tote box of claim 19, wherein the rim includes a handle extending therefrom.

25. The tote box of claim 12, further comprising:

a drain trough disposed on an upper edge of the end walls, the drain trough extending through the upper edge of the end walls;

a drain channel disposed on the lid halves, the drain channels extending through the outer perimeter edge of the lid halves;

wherein the drain channel is in fluid communication with the drain trough when the lid halves are secured.

26. The tote box of claim 25, further comprising:

a second drain trough disposed on the sidewalls;

a third drain trough disposed on the rear end of the lid halves;

wherein the third drain trough is in fluid communication with the second drain trough when the lid halves are secured.

27. The tote box of claim 12, further comprising:

a peg disposed on the lower surface of the first and second side of lid halves, the peg protruding outwardly from the lower surface;

a peg cavity disposed on the reinforcement shoulder of the end walls, the peg cavity configured to receive the peg therein.

28. The tote box of claim 12, wherein the drain gutter slopes downwardly from a first closed end disposed on an interior of the inner perimeter edge towards a second open end disposed on the outer perimeter edge, such that moisture captured by the drain gutter is directed down the slope toward a trough.

29. The tote box of claim 28, wherein a drain receptacle is sized to receive the second open end of the drain gutter therein, such that moisture flowing down the drain gutter is directed through a trough and the wall.

30. The tote box of claim 12, wherein the interlocking flaps include a lip, such that when the interlocking flaps overlap the drain gutters, the lips engage the drain gutters, thereby securing the lid halves at the line of connection.

* * * * *